US008167302B2

(12) United States Patent
Kawaguchi et al.

(10) Patent No.: US 8,167,302 B2
(45) Date of Patent: May 1, 2012

(54) PAPER INVERTING DEVICE

(75) Inventors: Akira Kawaguchi, Kinokawa (JP); Kazuya Yamamoto, Kinokawa (JP)

(73) Assignees: Duplo Seiko Corporation, Wakayama (JP); Seiko Epson Corporation, Tokyo (JP)

( * ) Notice: Subject to any disclaimer, the term of this patent is extended or adjusted under 35 U.S.C. 154(b) by 107 days.

(21) Appl. No.: 12/448,793

(22) PCT Filed: Aug. 28, 2008

(86) PCT No.: PCT/JP2008/002331

§ 371 (c)(1),
(2), (4) Date: Jul. 7, 2009

(87) PCT Pub. No.: WO2009/031280

PCT Pub. Date: Mar. 12, 2009

(65) Prior Publication Data

US 2010/0148422 A1 Jun. 17, 2010

(30) Foreign Application Priority Data

Sep. 7, 2007 (JP) ..... 2007-232474

(51) Int. Cl.
*B65H 29/00* (2006.01)

(52) U.S. Cl. ..... 271/186; 271/225; 271/276; 271/96

(58) Field of Classification Search ..... 271/225, 271/275, 276, 306, 184–186, 310, 194, 196, 271/197, 3.21–3.23, 94, 96
See application file for complete search history.

(56) References Cited

U.S. PATENT DOCUMENTS

| | | | | | |
|---|---|---|---|---|---|
| 1,709,006 | A | * | 4/1929 | Broadmeyer | 271/225 |
| 4,154,180 | A | * | 5/1979 | Burton | 112/475.06 |
| 4,844,442 | A | * | 7/1989 | Gammerler | 271/225 |
| 5,649,698 | A | * | 7/1997 | Auerbach et al. | 271/225 |
| RE38,867 | E | * | 11/2005 | Kusters | 271/225 |
| 7,014,187 | B2 | * | 3/2006 | Mayerberg et al. | 271/197 |
| 7,293,770 | B2 | * | 11/2007 | Edinger | 271/276 |
| 7,510,182 | B2 | * | 3/2009 | Bobrow | 271/185 |
| 7,918,449 | B2 | * | 4/2011 | Sugiyama et al. | 271/186 |
| 8,052,142 | B2 | * | 11/2011 | Sugiyama et al. | 271/225 |
| 2009/0051104 | A1 | * | 2/2009 | Sugiyama et al. | 271/225 |
| 2009/0057998 | A1 | * | 3/2009 | Ong | 271/276 |
| 2009/0121417 | A1 | * | 5/2009 | Nishimura et al. | 271/225 |

FOREIGN PATENT DOCUMENTS

| | | |
|---|---|---|
| JP | 05-107969 | 4/1993 |
| JP | 2000-109259 | 4/2000 |
| JP | 2005-170547 | 6/2005 |
| JP | 2006-044911 | 2/2006 |

* cited by examiner

*Primary Examiner* — Kaitlin Joerger
*Assistant Examiner* — Prasad Gokhale
(74) *Attorney, Agent, or Firm* — Fildes & Outland, P.C.

(57) ABSTRACT

A sheet of paper is reliably held by suction at the front and rear of a turn guide on the transport path of the sheet according to paper transport conditions.

8 Claims, 30 Drawing Sheets

PAPER INVERTING DEVICE

TECHNICAL FIELD

The present invention relates to a paper inverting device and a technique for inverting a sheet of paper at a point of a transport path of the sheet in a printer and the like.

BACKGROUND ART

In the prior art, this kind of device is described in, for example, Japanese Patent Laid-Open No. 54-57759. In this invention, a transport path is formed between an outer guide plate and an inner guide plate in the traveling direction of a sheet of paper. The transport path is inverted and the direction is changed by 90° relative to the traveling direction of the sheet, so that the sheet passing through the transport path between the outer guide plate and the inner guide plate is inverted by 180° and the direction is changed by 90°.

In Japanese Patent Laid-Open No. 63-134437, a sheet of paper is inverted at a point of a loop transport path around an axis along a transport direction.

In Japanese Patent Laid-Open No. 2000-135851, an intermediate transport path is provided like conveyer belts which are a plurality of belts looped over a pair of rollers. On the intermediate transport paths, an inverting/refeeding roller is disposed so as to have an axial direction at 45° relative to a transport direction, a plurality of auxiliary rollers pressed in contact with the inverting/refeeding roller are provided, and inverting guides disposed close to the outer surface of the inverting/refeeding roller with a small gap are provided between the auxiliary rollers.

Further, a sheet of paper is transported on the intermediate transport path while being sucked by a suction fan. The sheet introduced between the inverting/refeeding roller and the auxiliary rollers is guided by the inverting guide so as to be turned along the outer surface of the inverting/refeeding roller, so that the traveling direction of the sheet is changed by 90°.

In Japanese Patent Laid-Open No. 5-278894, an endless transport belt having a plurality of holes is looped over a pair of rollers, the transport belt is rotated by the driving of the rollers, a sheet of paper is sucked by a first sucking device which sucks air from the outer surface of the transport belt through the holes provided on the transport belt, and air is sucked from the outer surface of the transport belt through the holes of the transport belt by a second sucking device provided upstream from the first sucking device in a paper transport direction.

In Japanese Patent Laid-Open No. 2001-18512, the size and grammage of paper are detected by a paper size detector and a paper grammage detector, an ambient temperature and an ambient humidity are detected by a temperature/humidity detector, and the driving force of a motor for a fan is controlled by a control unit such that based on paper information having been detected by the paper size detector and the paper grammage detector, a proper paper suction force is obtained in consideration of the temperature and humidity having been detected by the temperature/humidity detector.

In Japanese Patent Laid-Open No. 1-104560, a device is provided for changing the suction force of a suction device according to the kind of paper in a transport device including the suction device.

DISCLOSURE OF THE INVENTION

Problems to be Solved by the Invention

In the configurations of the prior art, a sheet of paper is transported while being sandwiched (nipped) between the rollers and the rollers directly come into contact with the printed surface of the sheet. Thus when a paper inverting device configured according to the prior art is applied to a stencil duplicator and an inkjet printer, a printed surface may be smudged.

In a configuration for sucking a sheet of paper on a transport belt, the transport belt itself cannot form a curved inversion path. Thus a pair of transport devices including transport belts forming linear transport paths are sequentially disposed on the front end and the rear end of a paper transport direction, and a turn guide having a curved surface for inverting a sheet of paper is disposed between the transport devices. When a sheet of paper is inverted, the sheet is bent along the curved surface of the turn guide.

However, it is difficult to provide the turn guide with a sucking function and thus a suction force is not applied to a sheet of paper at the turn guide while the sheet is moved from one transport device to another. For this reason, the suction force of the turn guide may become insufficient and the sheet may be lifted depending on the kind of paper, for example, the thickness and size of paper or the transport speed of the transport device, so that a paper jam may occur or the sheet may be skewed.

The present invention has been devised to solve the problem. An object of the present invention is to provide a paper inverting device which does not bring members such as a roller into contact with the printed surface of a sheet of paper when the sheet is inverted and the direction is changed, can prevent smudges by eliminating an ink stain on the surface of the sheet, and can reliably hold the sheet by suction at the front and rear of a turn guide on the transport path of the sheet according to paper transport conditions.

Means for Solving the Problems

In order to solve the problem, a paper inverting device of the present invention for inverting a sheet of paper around an inversion axis by a predetermined inversion angle when the sheet is transferred from a first transport surface to a second transport surface, wherein a first transport device forming the first transport surface and a second transport device forming the second transport surface each include a plurality of transport belts moving on transport paths along a paper transport direction and a suction device for sucking the sheet on the transport belts through suction holes formed on the transport belts, a turn guide disposed in parallel with the inversion axis between the first transport device and the second transport device has curved inversion/transfer surfaces from inversion start points corresponding to the first transport surface to inversion end points corresponding to the second transport surface, and the suction device includes a plurality of suction machines disposed along the paper transport direction and a suction force controller for individually controlling the suction forces of the suction machines according to paper transport conditions.

With this configuration, the first transport device sucks on the transport belts the opposite side of the sheet from a printed surface through the suction holes formed on the transport belts, by means of the suction machines of the suction device. The transport belts move on the transport paths with the sheet in this state, so that the sheet is transported in the paper transport direction on the first transport surface.

When the sheet reaches the turn guide and one end of the sheet enters the inversion/transfer surfaces from the inversion start point of the turn guide, the turn guide guides the end of the sheet with the inversion/transfer surfaces as the sheet moves in the paper transport direction, the back side of the sheet comes into slidable contact with the inversion/transfer surfaces, and the surfaces of the sheet are inverted and curved along the inversion/transfer surfaces, following the end of the sheet.

When the sheet reaches the second transport device and the end of the sheet enters the second transport surface from the inversion end points of the inversion/transfer surfaces of the turn guide, the second transport device sucks on the transport belts the opposite side of the sheet from the printed surface through the suction holes formed on the transport belts, by means of the suction machines of the suction device. The transport belts move on the transport paths with the sheet in this state, so that the sheet is transported in the paper transport direction on the second transport surface. At this point, the first transport device transports the sheet until the rear end of the sheet reaches the inversion start point of the turn guide.

Consequently, while the sheet is transferred from the first transport surface of the first transport device to the second transport surface of the second transport device through the inversion/transfer surfaces of the turn guide, the sheet is inverted at the turn guide around the inversion axis by a predetermined inversion angle in a state in which the back side of the sheet is in slidable contact with the inversion/transfer surfaces of the turn guide, without bringing the printed surface of the sheet into contact with the component members of the inverting device.

Thus members such as a roller do not come into contact with the printed surface of the sheet during the inversion of the sheet and it is possible to prevent smudges by eliminating an ink stain on the surface of the sheet. In the foregoing operation, the suction force controller individually controls the suction forces of the suction machines according to the paper transport conditions, so that the suction forces can be flexibly adjusted according to a transport state of the sheet.

Further, the suction force controller sets the suction force of the suction machine closest to the inversion start points of the inversion/transfer surfaces stronger than the suction forces of the other suction machines in the first transport device.

Further, the suction force controller sets the suction force of the suction machine closest to the inversion end points of the inversion/transfer surfaces stronger than the suction forces of the other suction machines in the second transport device.

With this configuration, the suction force of the suction machine closest to the turn guide is set stronger than the suction forces of the other suction machines according to the paper transport conditions including the kind (size, thickness, and so on) of the sheet or the transport speed of the transport device, so that it is possible to reliably hold the sheet by suction at the front and rear of the turn guide on the transport path of the sheet. Thus it is possible to prevent a paper jam caused by the sheet lifted at the turn guide and prevent skewing. In this case, an increase in the suction forces of all the suction machines results in excessive suction energy. Energy consumption can be suppressed by increasing only the suction force of the suction machine closest to the turn guide.

Moreover, the suction force controller sets the suction force of the suction machine closest to the transport start end of the first transport surface stronger than the suction forces of the other suction machines in the first transport device.

With this configuration, the suction machine on the transport start end of the first transport device strongly sucks the end of the sheet entering the first transport surface from a printing process. Thus even when the sheet enters the first transport surface with a curled end, the end of the sheet can be reliably sucked on the transport belts. Further, the timing of the suction of the end of the sheet is not shifted and thus the sheet can be reliably transported by suction in synchronization with transport from the printing process without causing a transport delay or a slip. In this case, an increase in the suction forces of all the suction machines results in excessive suction energy. Energy consumption can be suppressed by increasing only the suction force of the suction machine closest to the turn guide.

Moreover, the suction machines of the first transport device and the second transport device each include a suction box for supporting the transport belts under the transport paths and a suction source, the suction box composes a suction air flow path to the suction source from openings formed under the transport paths of the transport belts, in the suction machine closest to the inversion start points of the inversion/transfer surfaces in the first transport device, the length of the suction box in the paper transport direction and the formation range of the openings in the paper transport direction are set smaller than the lengths and formation ranges of the other suction machines, and in the suction machine closest to the inversion end points of the inversion/transfer surfaces in the second transport device, the length of the suction box in the paper transport direction and the formation range of the openings in the paper transport direction are set smaller than the lengths and formation ranges of the other suction machines.

With this configuration, an amount of leakage decreases at the openings of suction air and a suction force applied to the sheet on the transport belts increases. Thus the suction force of the suction machine closest to the turn guide is increased as compared with the suction forces of the other suction machines, so that the sheet can be reliably held by suction at the front and rear of the turn guide on the transport path of the sheet and it is possible to prevent a paper jam caused by the sheet lifted at the turn guide and prevent skewing.

Further, the first transport device includes a suction box for supporting the transport belts under the transport paths and a suction source, the suction box composes a suction air flow path to the suction source from openings formed under the transport paths of the transport belts, and in the suction machine closest to the transport start end of the first transport surface in the first transport device, the length of the suction box in the paper transport direction and the formation range of the openings in the paper transport direction are set smaller than the lengths and formation ranges of the other suction machines.

With this configuration, an amount of leakage decreases at the openings of suction air and a suction force applied to the sheet on the transport belts increases. Thus the suction machine on the transport start end of the first transport device strongly sucks the end of the sheet entering the first transport surface from the printing process. Thus even when the sheet enters the first transport surface with a curled end, the end of the sheet can be reliably sucked on the transport belts. Further, the timing of the suction of the end of the sheet is not shifted and thus the sheet can be reliably transported by suction in synchronization with transport from the printing process without causing a transport delay or a slip.

Moreover, the suction machine closest to the inversion start points of the inversion/transfer surfaces in the first transport device and the suction machine closest to the inversion end points of the inversion/transfer surfaces in the second transport device each include a suction box which supports the transport belts under the transport paths and has openings formed under the transport paths and an opening adjusting device for making a variable adjustment on the opening degree of the opening of the suction box in a paper width direction orthogonal to the paper transport direction.

With this configuration, when the sheet is transported by the first transport device and the second transport device by suction on the transport belts, the sheet is not placed on some of the transport belts depending on the size of the sheet. When air flows into the suction boxes through the suction holes and the openings of the suction boxes on the transport belts where the sheet is not placed, a suction force applied to the sheet decreases.

For this reason, the opening adjusting device adjusts the opening degrees of the openings of the suction boxes according to the size of the sheet and closes the openings corresponding to the transport belts not involved in the transport of the sheet. Thus it is possible to prevent an unnecessary air flow and increase the suction force applied to the sheet. Consequently, by setting the suction force of the suction machine closest to the turn guide stronger than the suction forces of the other suction machines according to the size of the sheet, the sheet can be reliably held by suction at the front and rear of the turn guide on the transport path of the sheet. Thus it is possible to prevent a paper jam caused by the sheet lifted at the turn guide and prevent skewing.

Moreover, the paper inverting device includes a sensor device for detecting the transport position of the sheet in the first transport device and the second transport device, wherein the suction force controller sequentially drives at least the suction machines corresponding to the transport positions of the sheet as the sheet moves in the transport direction.

With this configuration, when driving all the suction machines including the suction machines which are not disposed on the transport positions of the sheet and are not involved in transport, such driving causes excessive energy consumption. By sequentially driving only the minimum necessary suction machines including at least the suction machines corresponding to the transport positions of the sheet as the sheet moves in the transport direction, energy consumption can be minimized and noise can be reduced.

Further, the suction force controller controls the suction forces of the suction machines according to at least one of the paper transport conditions including the kind of paper and a transport speed.

With this configuration, the suction force of the suction machine is changed according to the kind of paper, for example, the size, thickness and so on or a transport speed by controlling the voltage of a driving source. Thus it is possible to minimize energy consumption according to the paper transport conditions.

Advantages of the Invention

As has been discussed, according to the present invention, the printed surface of a sheet of paper is inverted at a turn guide around an inversion axis without coming into contact with the component members of an inverting device while the sheet is transferred from the first transport surface of a first transport device to the second transport surface of a second transport device through the inversion/transfer surfaces of the turn guide. Thus it is possible to prevent smudges by eliminating an ink stain on the surface of the sheet. The suction force controller individually controls the suction forces of the suction machines according to paper transport conditions, so that the suction forces can be flexibly adjusted according to a transport state of the sheet. By setting the suction force of the suction machine closest to the turn guide stronger than the suction forces of the other suction machines, it is possible to reliably hold the sheet by suction at the front and rear of the turn guide and prevent a paper jam and skewing. The end of the sheet entering the first transport surface is strongly sucked by the suction machine on the transport start end of the first transport device, so that even the end of a curled sheet can be reliably sucked on transport belts and a transport delay and a slip can be prevented. By sequentially driving only the minimum necessary suction machines including at least the suction machines corresponding to the transport positions of the sheet as the sheet moves in the transport direction, energy consumption can be minimized and noise can be reduced.

BEST MODE FOR CARRYING OUT THE INVENTION

The following will describe embodiments of the present invention in accordance with the accompanying drawings. First, referring to FIGS. 23 to 27, the application of a paper inverting device and the transport path of a sheet of paper will be discussed according to the present invention.

Figure 23:
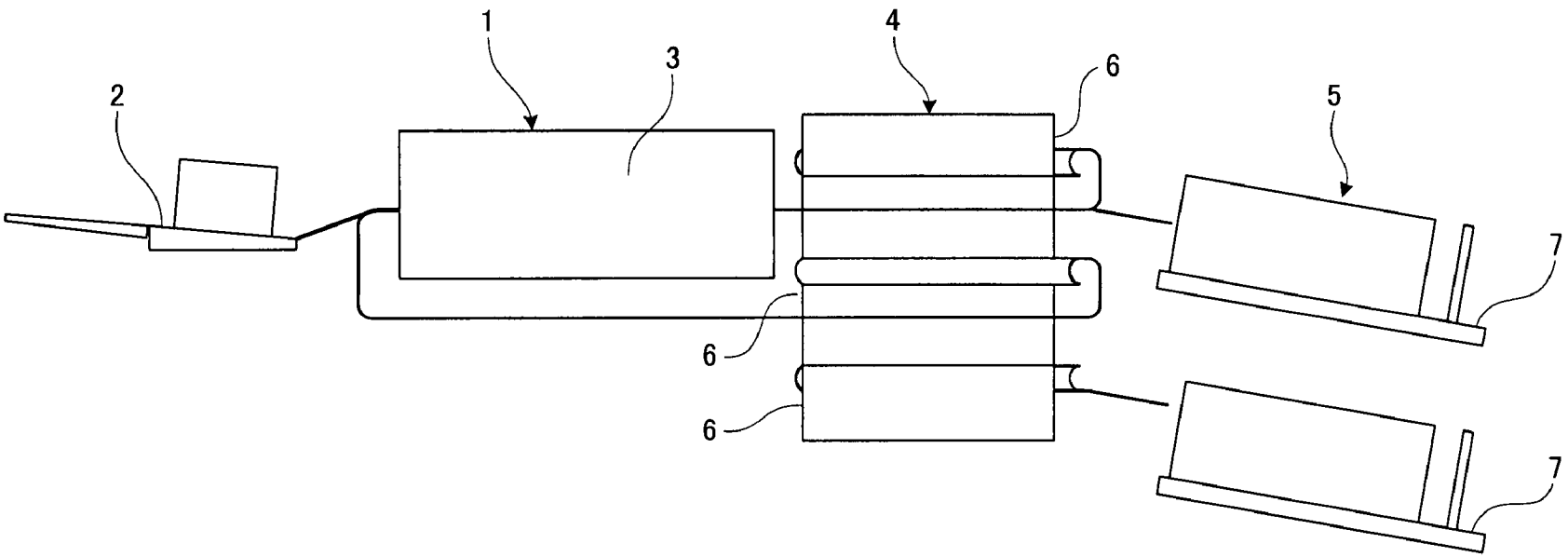
FIG. 23 is a schematic diagram showing a transport path of a sheet according to the embodiment of the present invention.
Figure 24:
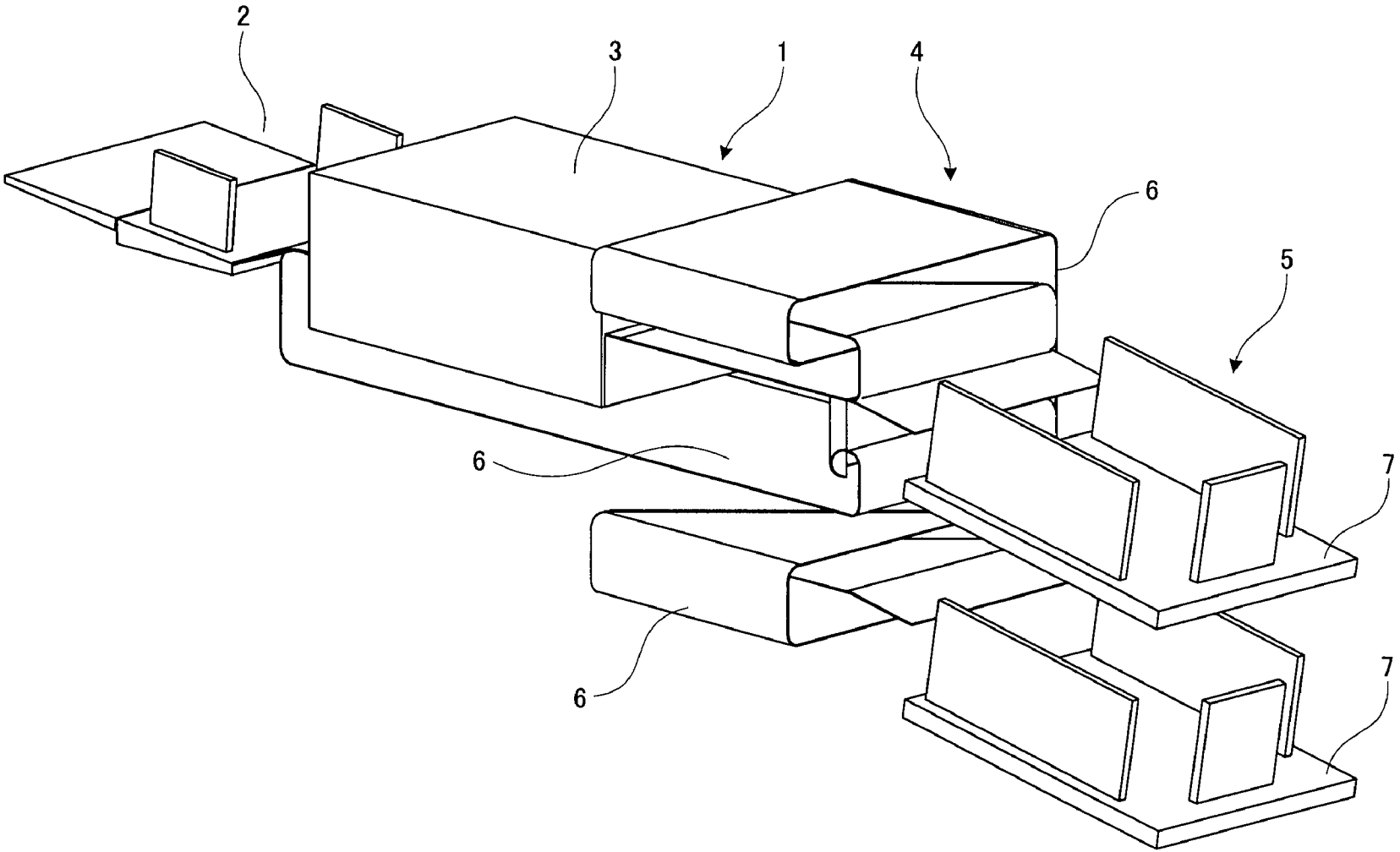
FIG. 24 is a schematic diagram showing the transport path of the sheet according to the embodiment of the present invention.

FIGS. 23 and 24 illustrate an ink jet printer as an application of the paper inverting device of the present invention. The present invention is also applicable to a stencil duplicator, a screen printer, and so on.

(Overall Configuration)

An ink jet printer 1 is made up of a paper feed mechanism 2, a printer body 3, a paper inverting mechanism 4, and a paper receiving mechanism 5. In this configuration, the printer body 3 performs printing by jetting water-based ink to a surface of a sheet of paper according to an inkjet printing system. The paper inverting mechanism 4 is a combination of a plurality of inverting transfer units 6 which are respectively disposed on the top stage, the middle stage, and the bottom stage, so that a plurality of transport paths can be selectively formed. The paper receiving mechanism 5 is made up of a plurality of paper receiving units 7. Sheets of paper ejected from the paper inverting mechanism 4 are received by the paper receiving units 7 which selectively correspond to the plurality of transport paths formed in the paper inverting mechanism 4.

(Single-Sided Printing)

Figure 25:
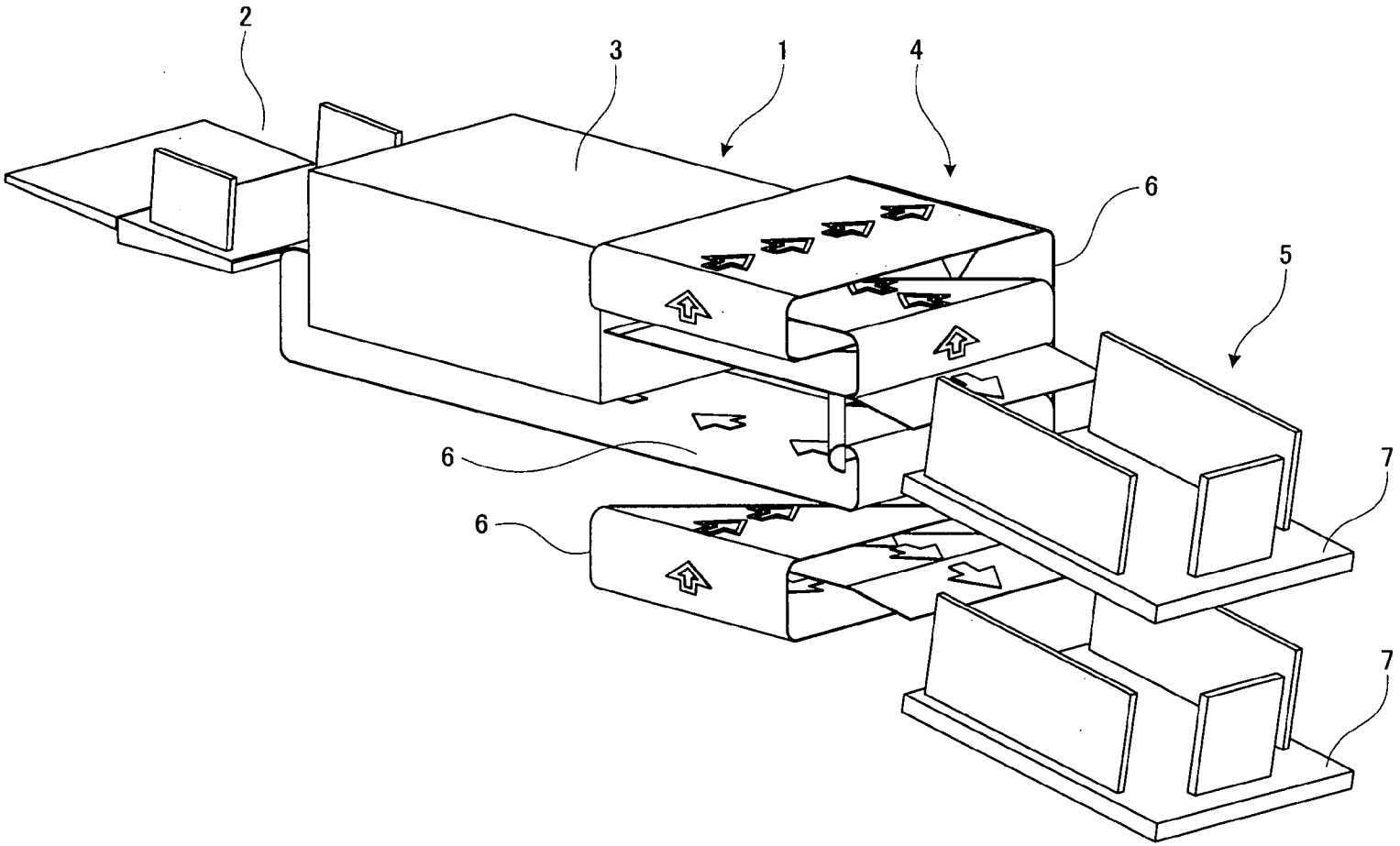
FIG. 25 is a schematic diagram showing the transport path of the sheet according to the embodiment of the present invention.
Figure 26:
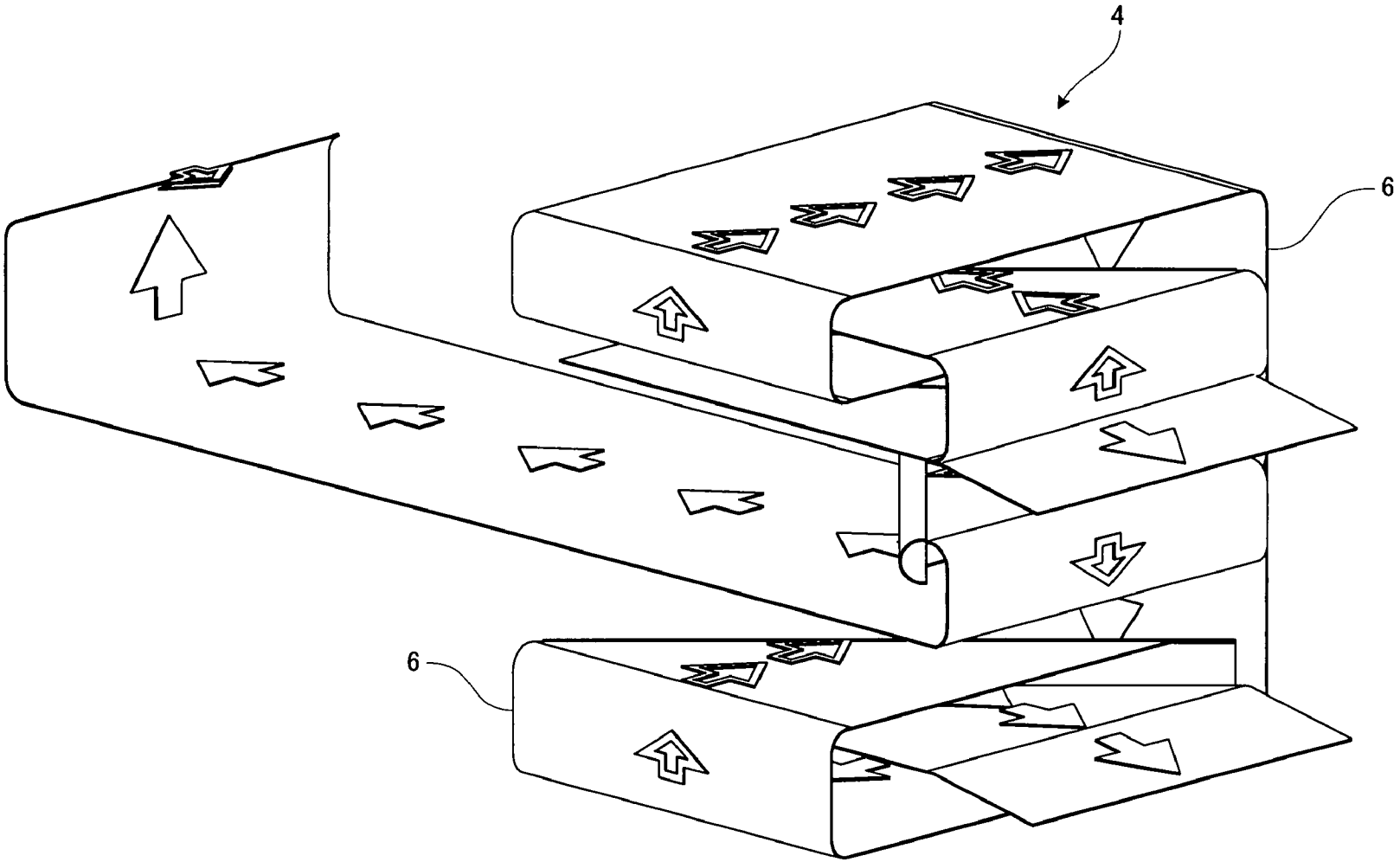
FIG. 26 is a schematic diagram showing the transport path of the sheet according to the embodiment of the present invention.
Figure 27:
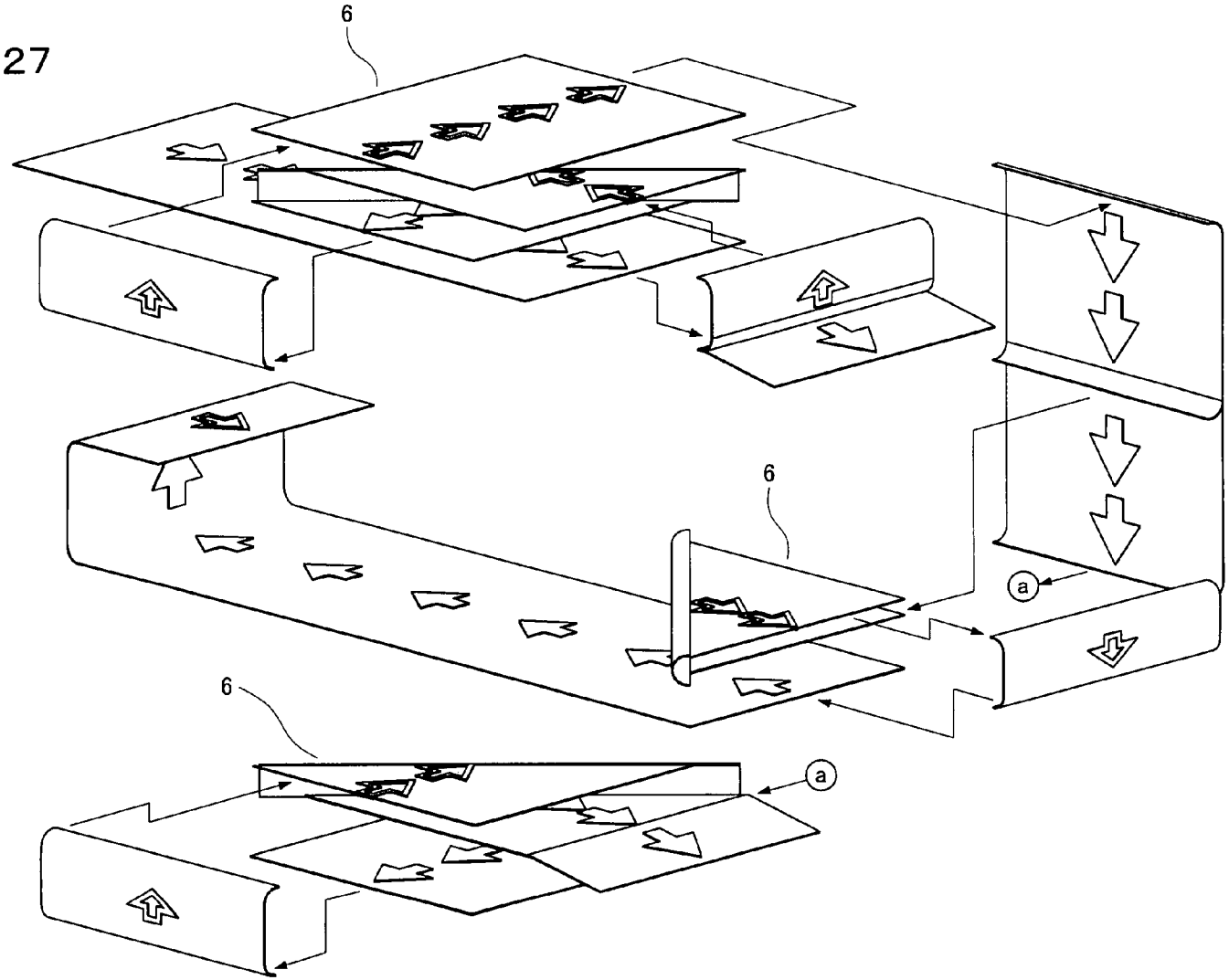
FIG. 27 is a schematic diagram showing the transport path of the sheet according to the embodiment of the present invention.

As shown in FIGS. 25 to 27, the paper feed mechanism 2 feeds sheets of paper one by one to the printer body 3. One side of the sheet is printed in the printer body 3 and the printed sheet is ejected to the paper receiving unit 7 through the paper inverting mechanism 4. When the sheet is ejected to the paper receiving unit 7 in the shortest time after the sheet is printed in the printer body 3, the sheet is passed through the inverting transfer unit 6 on the top stage of the paper inverting mechanism 4 without being inverted and then the sheet reaches the paper receiving unit 7.

After printed in the printer body 3, when the sheet of paper has to be kept in the paper inverting mechanism for a longer time to dry the printed surface of the sheet, the sheet is inverted by the inverting transfer unit 6 on the top stage of the paper inverting mechanism 4, is transferred to the inverting transfer unit 6 on the bottom stage, is inverted by the inverting transfer unit 6 on the bottom stage, and then reaches the lower paper receiving unit 7.

(Double-Sided Printing)

The paper feed mechanism 2 feeds sheets of paper one by one to the printer body 3. One side of the sheet is printed in the printer body 3. After printed in the printer body 3, the sheet is inverted in the inverting transfer unit 6 on the top stage of the paper inverting mechanism 4, is inverted by the inverting transfer unit 6 on the middle stage, and then is returned to the feed port of the printer body 3. After that, the other side of the sheet is printed in the printer body 3. After printed in the printer body 3, the sheet is inverted in the inverting transfer unit 6 on the top stage of the paper inverting mechanism 4, is transferred to the inverting transfer unit 6 on the bottom stage, is inverted by the inverting transfer unit 6 on the bottom stage, and then reaches the paper receiving unit 7 of the bottom stage.

Figure 28:
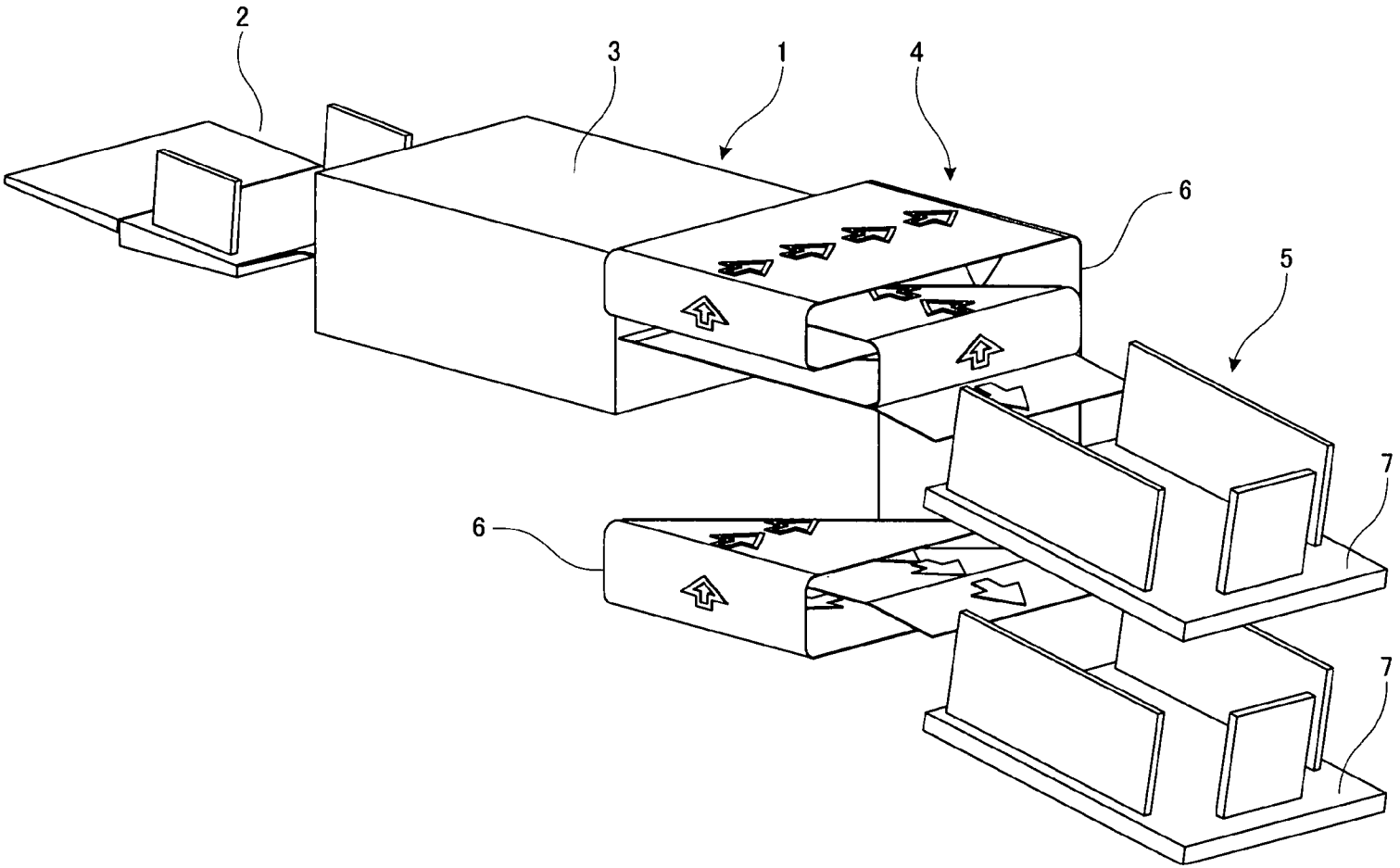
FIG. 28 is a schematic diagram showing a transport path of a sheet according to the embodiment of the present invention.
Figure 29:
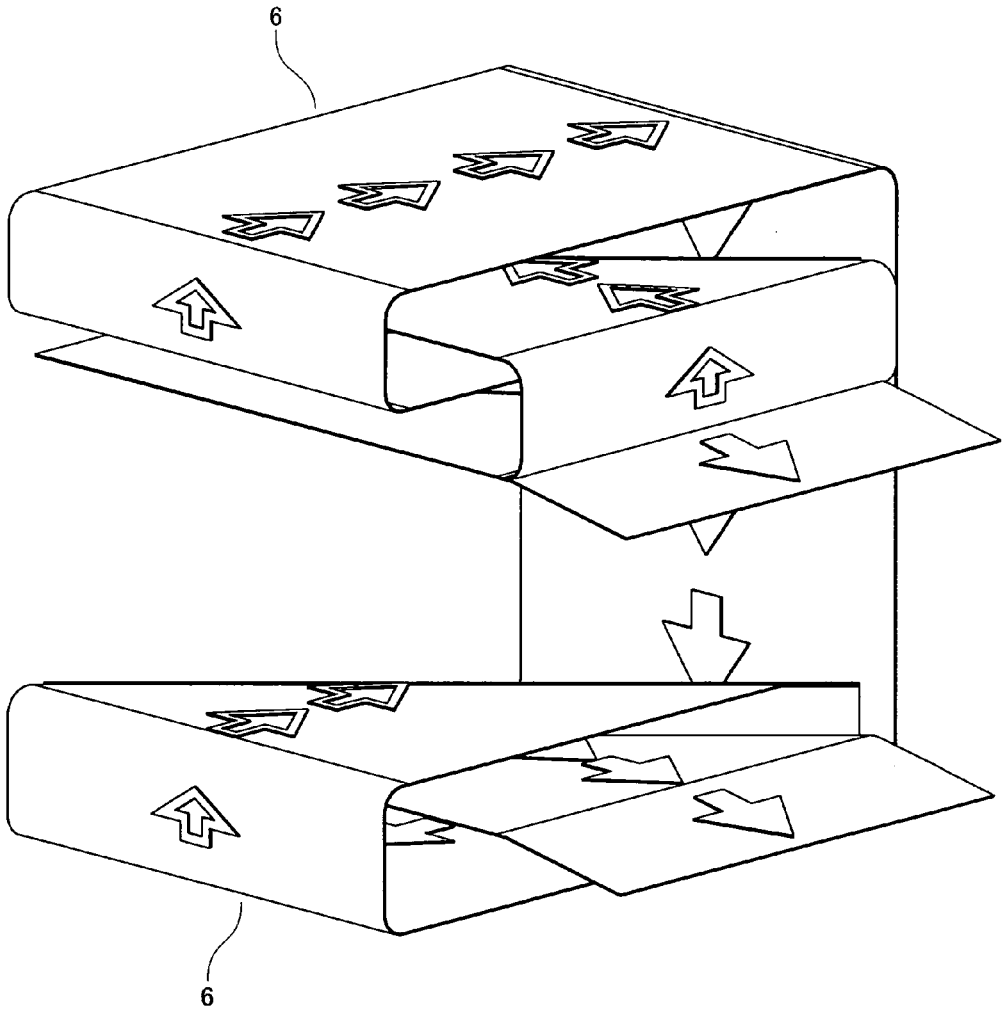
FIG. 29 is a schematic diagram showing the transport path of the sheet according to the embodiment of the present invention.
Figure 30:
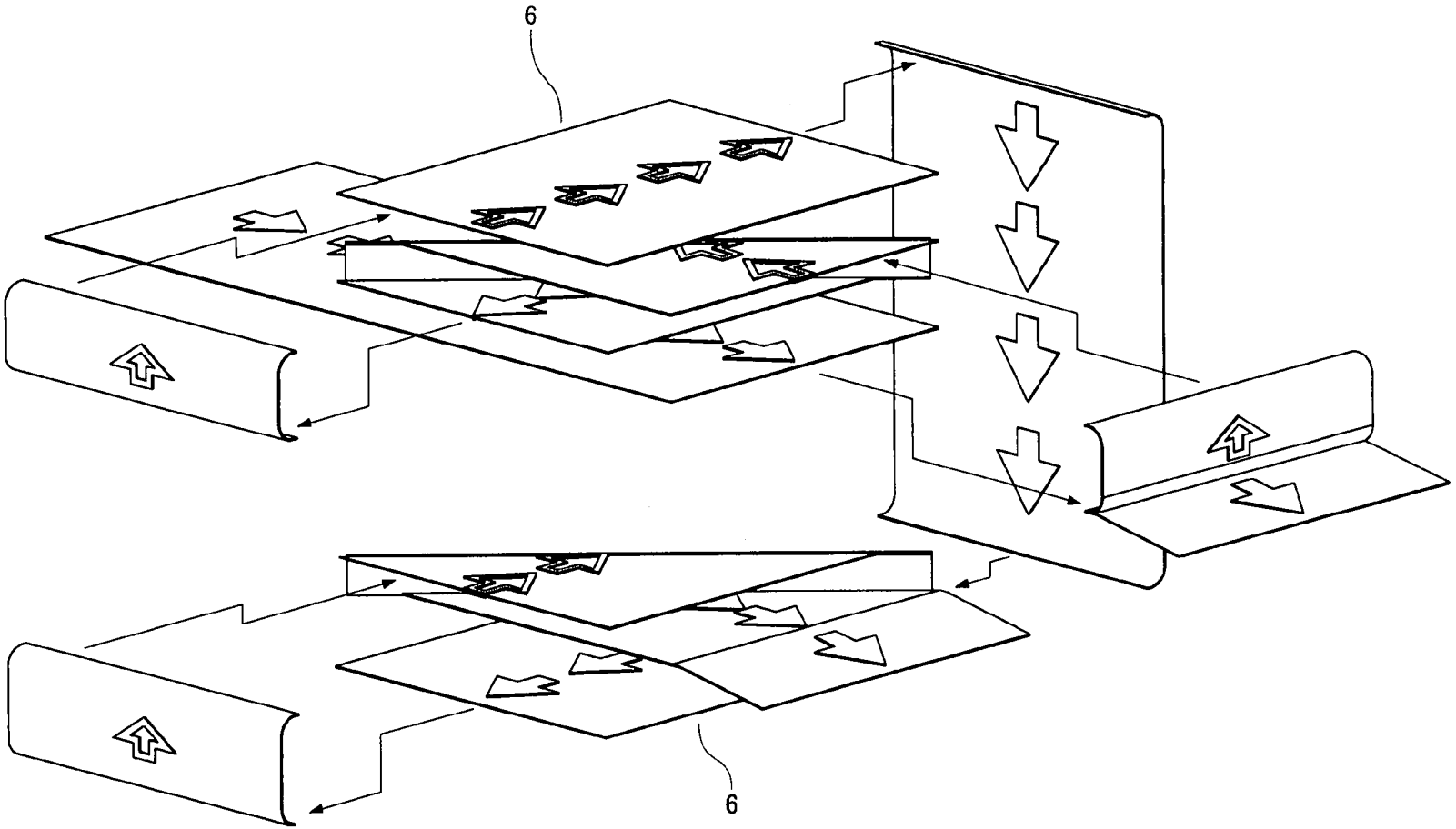
FIG. 30 is a schematic diagram showing the transport path of the sheet according to the embodiment of the present invention.

Referring to FIGS. 28 to 30, another application of the paper inverting device of the present invention will be described below.

(Overall Configuration)

In the following explanation, the same constituent elements as the constituent elements of the foregoing configuration are indicated by the same reference numerals. In this configuration, a paper inverting mechanism is a combination of upper and lower inverting transfer units 6 which can selectively form a plurality of transport paths.

(Single-Sided Printing)

As shown in FIGS. 28 to 30, a paper feed mechanism 2 feeds sheets of paper one by one to a printer body 3. One side of the sheet is printed in the printer body 3 and the printed sheet is ejected to a paper receiving unit 7 through a paper inverting mechanism 4. When the sheet is ejected to the paper receiving unit 7 in the shortest time after the sheet is printed in the printer body 3, the sheet is passed through the upper inverting transfer unit 6 of the paper inverting mechanism 4 without being inverted, and then the sheet reaches the paper receiving unit 7.

After printed in the printer body 3, when the sheet of paper has to be kept in the paper inverting mechanism for a longer time to dry the printed surface of the sheet, the sheet is inverted by the upper inverting transfer unit 6 of the paper inverting mechanism 4, is transferred to the lower inverting transfer unit 6, is inverted by the lower inverting transfer unit 6, and then reaches the lower paper receiving unit 7.

Figure 1:
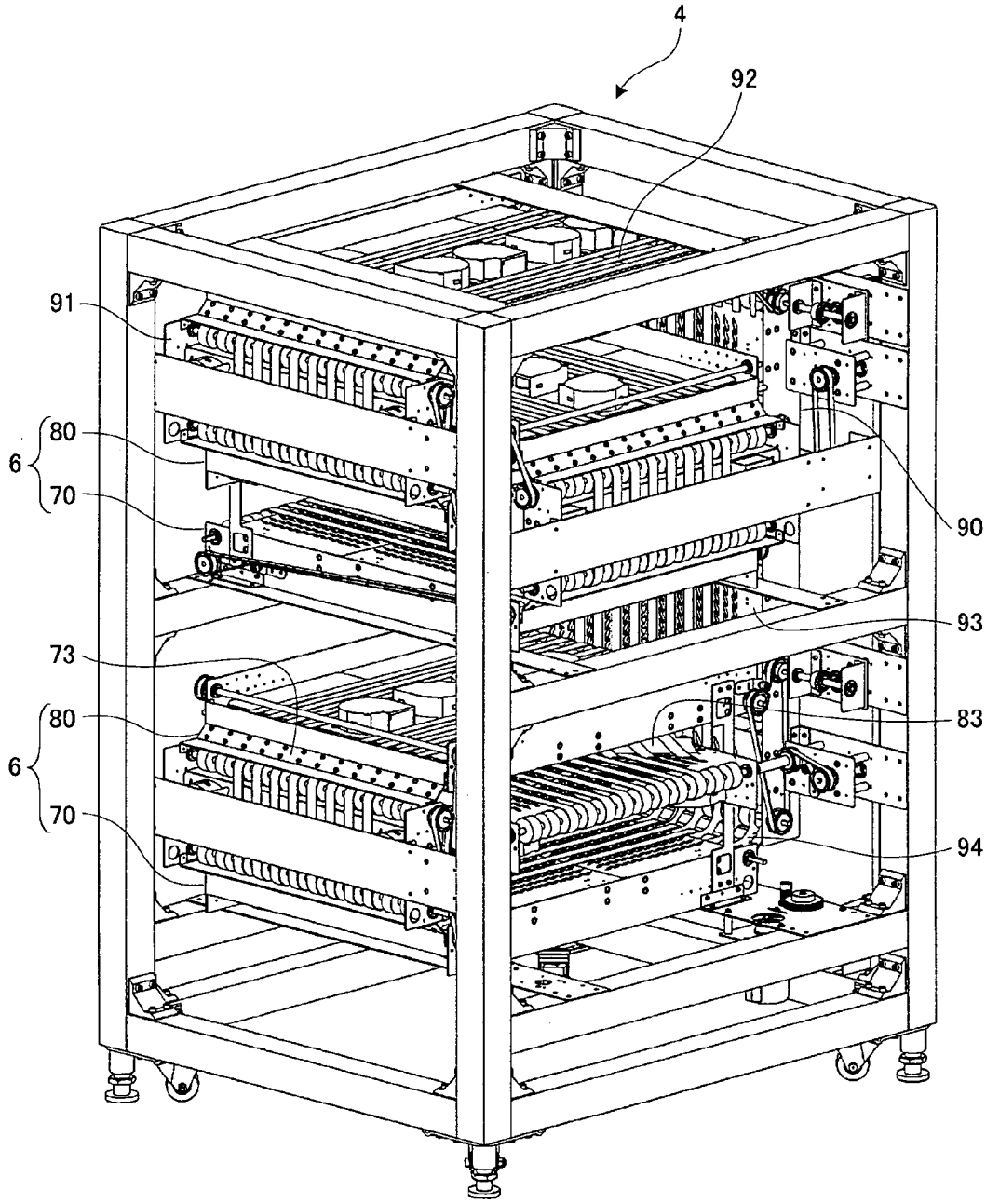
FIG. 1 is a perspective view showing a paper inverting device according to an embodiment of the present invention.

Referring to FIGS. 1 to 7, the paper inverting mechanism 4 of the present invention will be specifically described below. In FIG. 1, the paper inverting mechanism includes the plurality of inverting transfer units 6 which are vertically stacked. Each of the inverting transfer units 6 includes a first paper inverting device 70, a second paper inverting device 80, and a third paper inverting device 90 between the upper and lower inverting transfer units 6. The paper inverting mechanism 4 shown in FIGS. 1 to 7 does not have a mechanism of returning sheets of paper to the printer body 3 but such a mechanism can be easily realized according to the following explanation.

Figure 2:
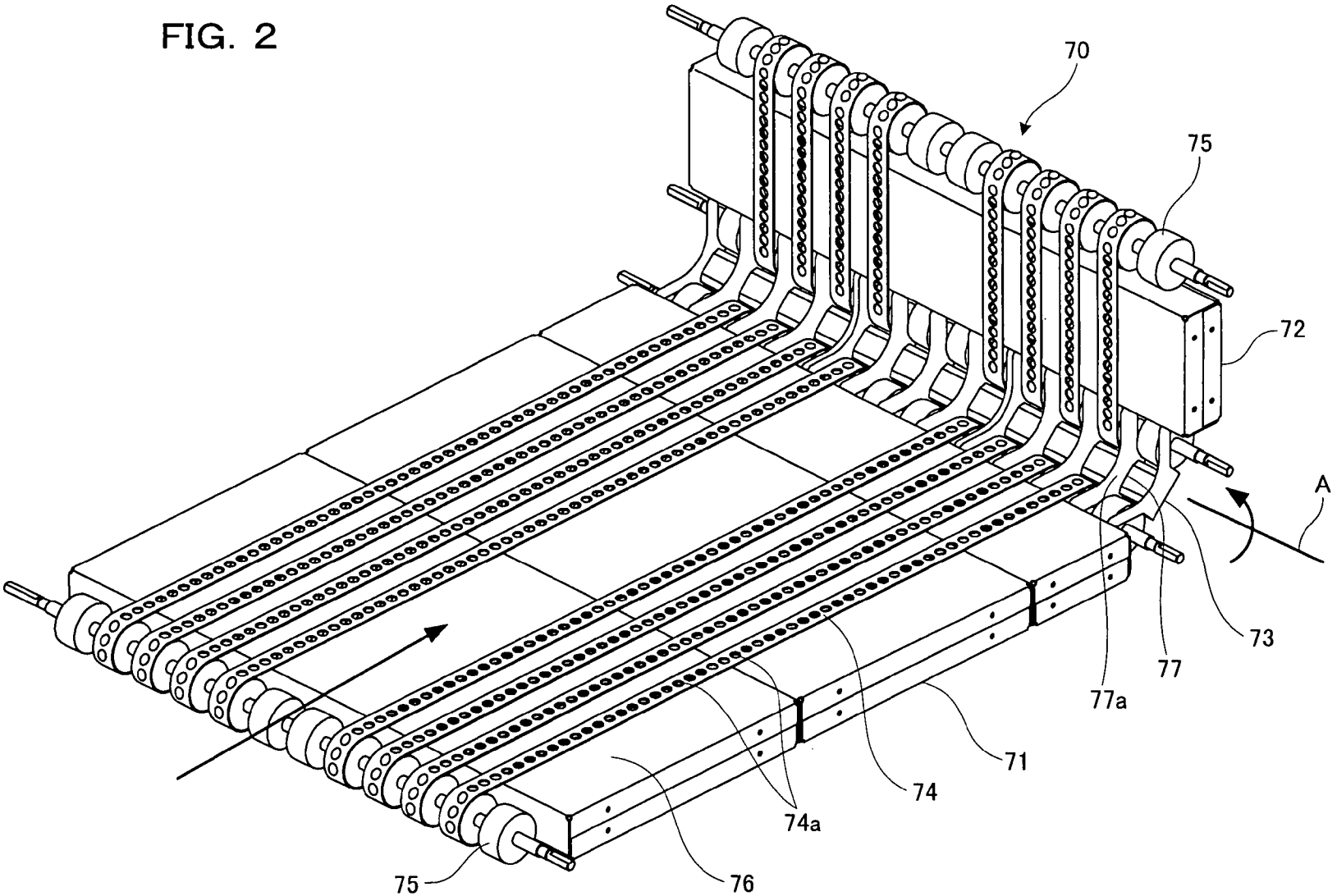
FIG. 2 is a perspective view showing a first paper inverting device according to the embodiment.

As shown in FIG. 2, the first paper inverting device includes a first transport device 71 forming a first transport surface on which a sheet of paper is transported in the horizontal direction, a second transport device 72 forming a second transport surface on which a sheet of paper is transported in a direction orthogonal to the first transport surface, and a turn guide 73 for inverting a sheet of paper around an inversion axis A by a predetermined inversion angle, in this case, by 90° when the sheet is transferred from the first transport surface to the second transport surface.

The first transport device 71 and the second transport device 72 include a plurality of transport belts 74 moving on transport paths along paper transport directions. The transport belts 74 are each made up of an endless belt looped over belt rollers 75 disposed on both ends of the transport path.

Figure 9:
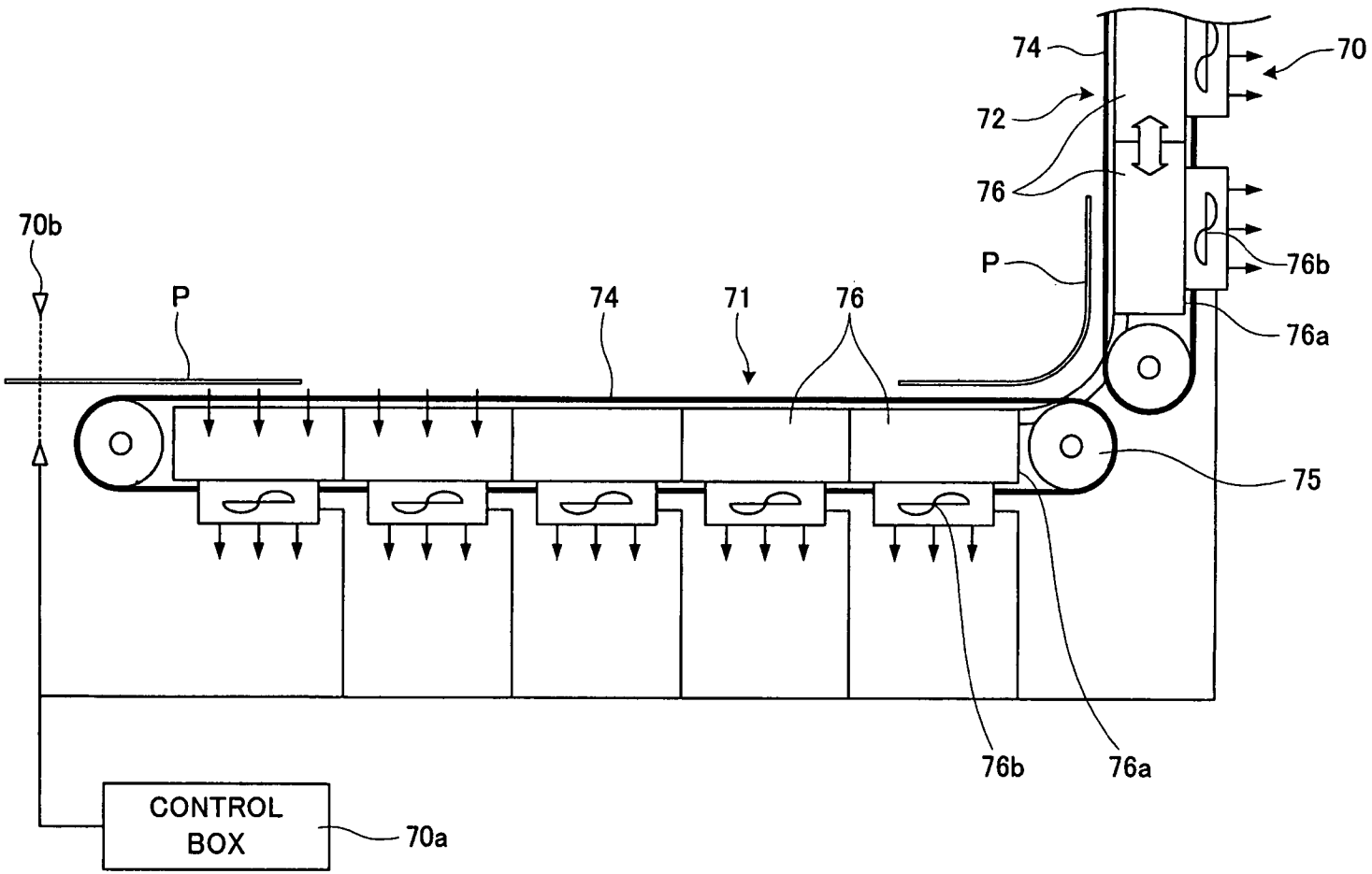
FIG. 9 is a side view showing the first paper inverting device according to the embodiment.

As shown in FIG. 9, in the first transport device 71 and the second transport device 72, a plurality of suction machines 76 acting as suction devices are disposed along the paper transport directions. The transport paths are formed on suction boxes 76*a* of the suction machines 76, and the suction boxes 76*a* each communicate with an air suction source, in this case, a suction fan device 76*b*.

The first paper inverting device 70 includes a control BOX 70*a* acting as a suction force controller for individually controlling the suction forces of the suction machines 76 of the first transport device 71 and the second transport device 72. The control BOX 70*a* controls the suction forces of the suction machines 76 by controlling the suction fan devices 76*b* according to at least one of paper transport conditions including the kind (size, thickness, and so on) of a sheet P and a transport speed (the traveling speed of the transport belt).

On the transport start end of the first transport device 71, a sensor 70*b* is provided as a sensor device for detecting the transport position of a sheet. After the sensor 70*b* detects the passage of a sheet, the current transport position of the sheet in the first transport device 71 and the second transport device 72 is calculated by counting the number of steps of an encoder mounted in the driving motor of the belt rollers 75.

Figure 10A:
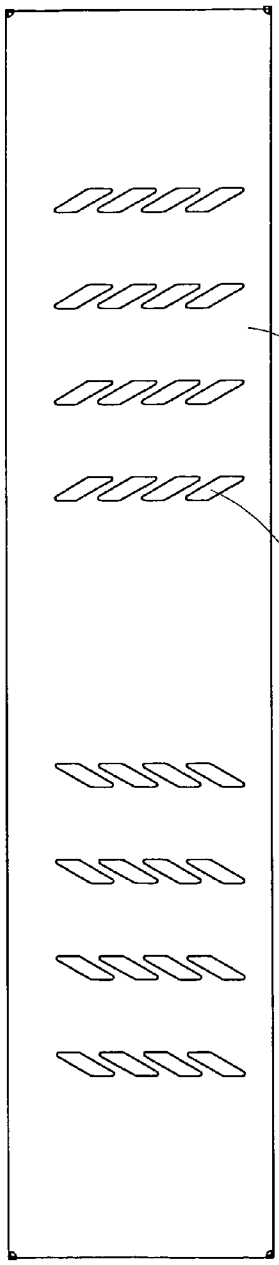
FIG. 10 is a schematic diagram showing the detail of transport devices according to the embodiment of the present invention.
Figure 10B:
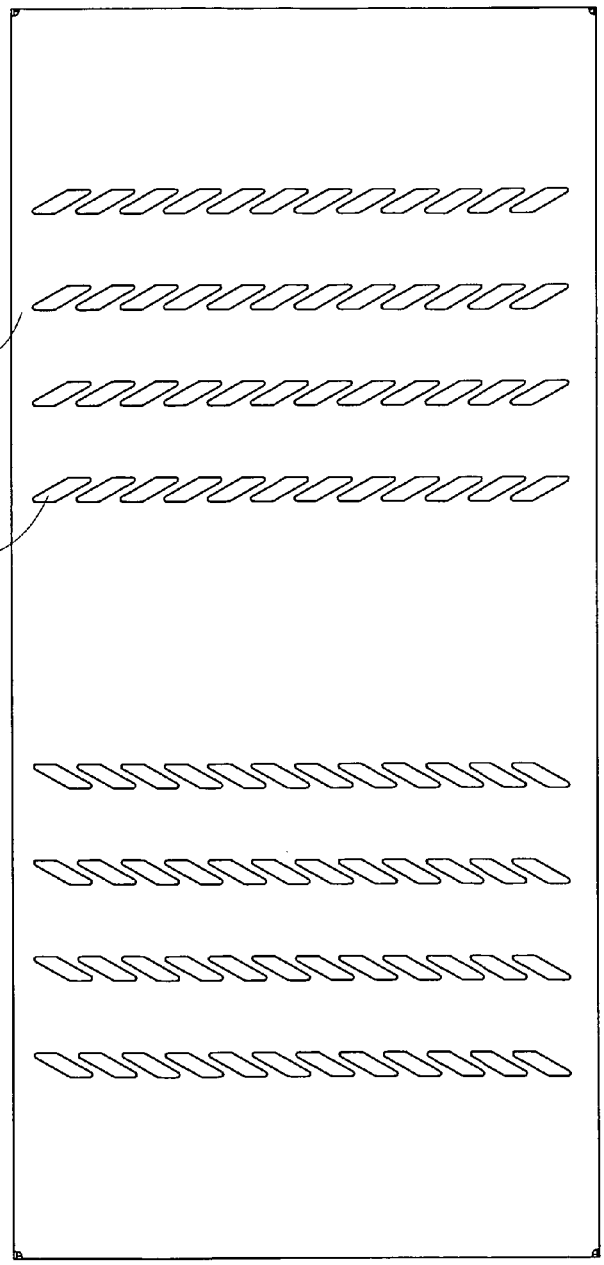
Figure 19:
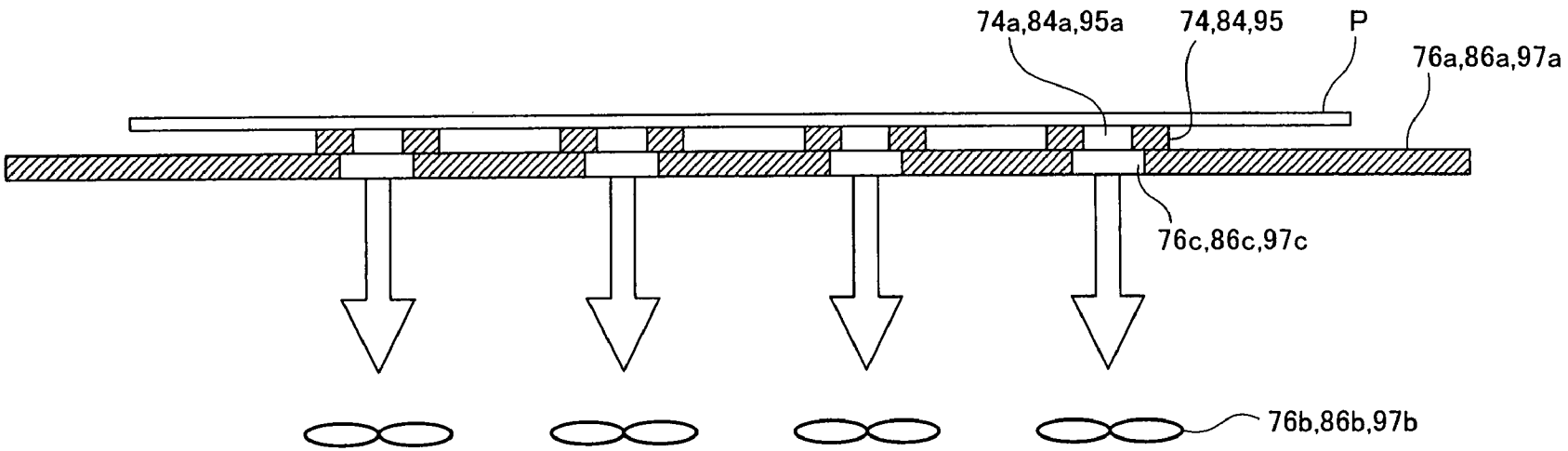
FIG. 19 is a sectional view showing a transport state in the transport devices according to the embodiment of the present invention.

As shown in FIGS. 10A, 10B, and 19, the suction box 76*a* has a plurality of openings 76*c* under the transport paths of the transport belts 74 and composes a suction air flow path from the openings 76*c* to the suction fan device 76*b*. The suction machines 76 suck the sheet P on the transport belts through suction holes 74*a* formed on the transport belts 74.

Figure 6:
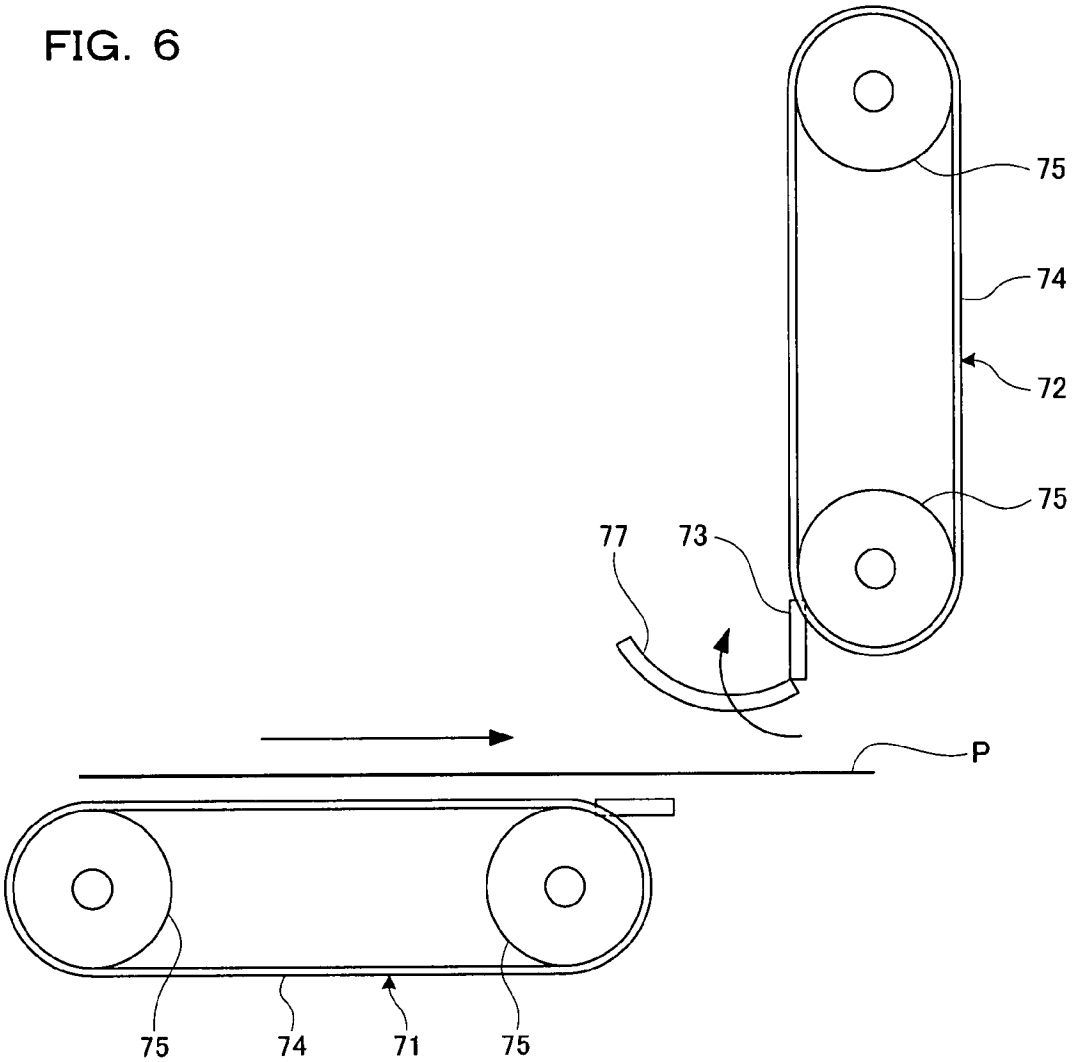
FIG. 6 is a side view showing the ejection mode of the turn guide in the first paper inverting device according to the embodiment.
Figure 7:
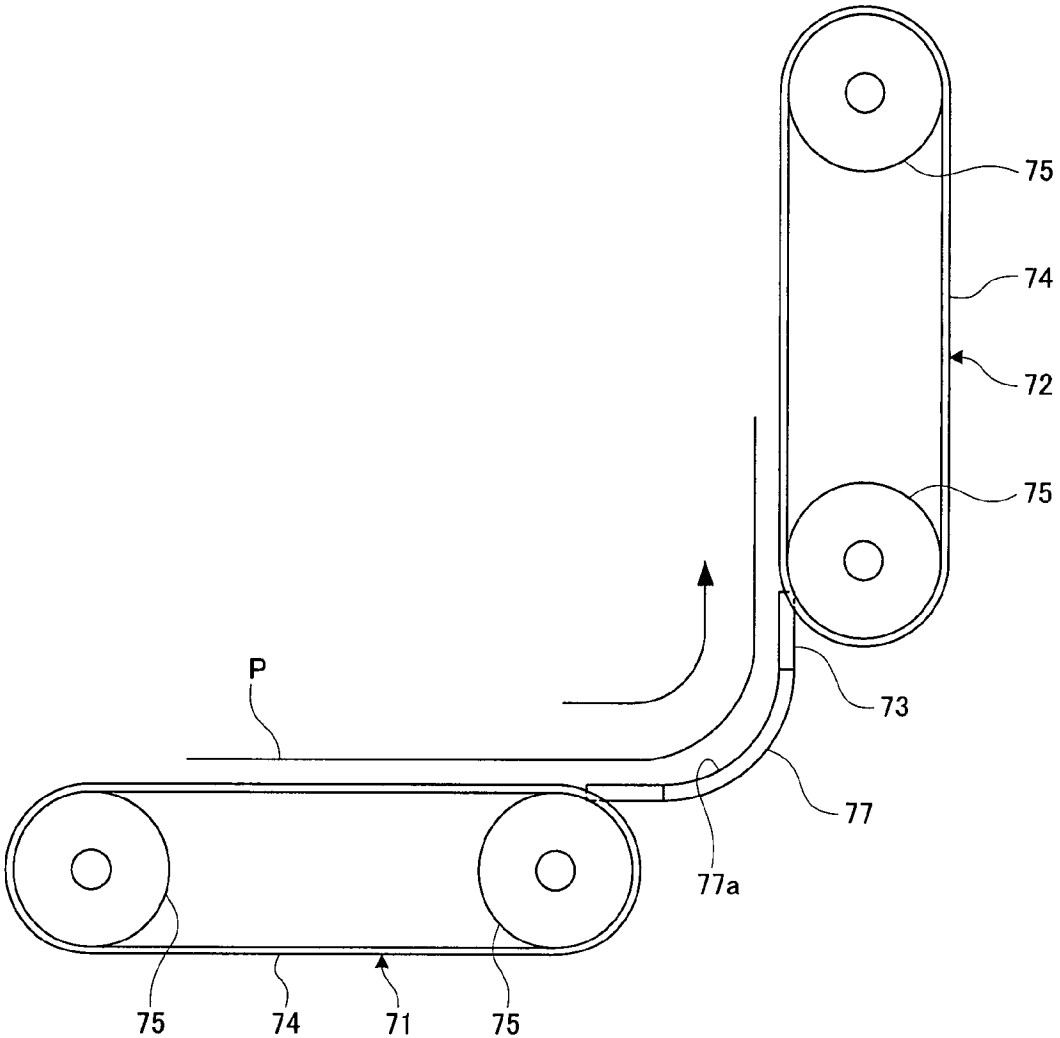
FIG. 7 is a side view showing the inversion mode of the turn guide in the first paper inverting device according to the embodiment.

The turn guide 73 has a plurality of guide ribs 77 which are arranged along the inversion axis with a 20-mm to 50-mm pitch and are interposed between the transport belts 74. The guide ribs 77 which are in slidable contact with the sheet P have slidable contact portions forming curved inversion/transfer surfaces 77*a* from an inversion start point corresponding to the first transport surface to an inversion end point corresponding to the second transport surface. As shown in FIGS. 6 and 7, the guide ribs 77 can swing between a state in which the first transport surface and the second transport surface are connected to each other and a state in which the first transport surface and the second transport surface are separated from each other.

The control BOX 70*a* sets the suction force of the suction machine 76 closest to the inversion start points of the inversion/transfer surfaces 77*a* stronger than the suction forces of the other suction machines 76 in the first transport device 71, and sets the suction force of the suction machine 76 closest to the inversion end points of the inversion/transfer surfaces 77*a* stronger than the suction forces of the other suction machines 76 in the second transport device 72 as necessary. Further, the control BOX 70*a* sets the suction force of the suction machine 76 closest to the transport start end of the first transport surface stronger than the suction forces of the other suction machines 76 in the first transport device 71.

The suction force of the suction machine 76 can be also increased as follows: as shown in FIGS. 10A and 10B, in the suction machine 76 closest to the inversion start points of the inversion/transfer surfaces 77*a* in the first transport device 71, the length of the suction box 76*a* [see FIG. 10A] in the paper transport direction and the formation range of the openings in the paper transport direction are set smaller than the lengths and formation ranges of the other suction machines 76 [FIG. 10B], in the suction machine 76 closest to the inversion end points of the inversion/transfer surfaces 77*a* in the second transport device 72, the length of the suction box 76*a* in the paper transport direction and the formation range of the openings in the paper transport direction are set smaller than the lengths and formation ranges of the other suction machines 76, or in the suction machine closest to the transport start end of the first transport surface, the length of the suction box 76*a* in the paper transport direction and the formation range of the openings in the paper transport direction are set smaller than the lengths and formation ranges of the other suction machines 76. This method can be also performed while the suction fan devices 76*b* are controlled by the control BOX 70*a*.

Figure 8:
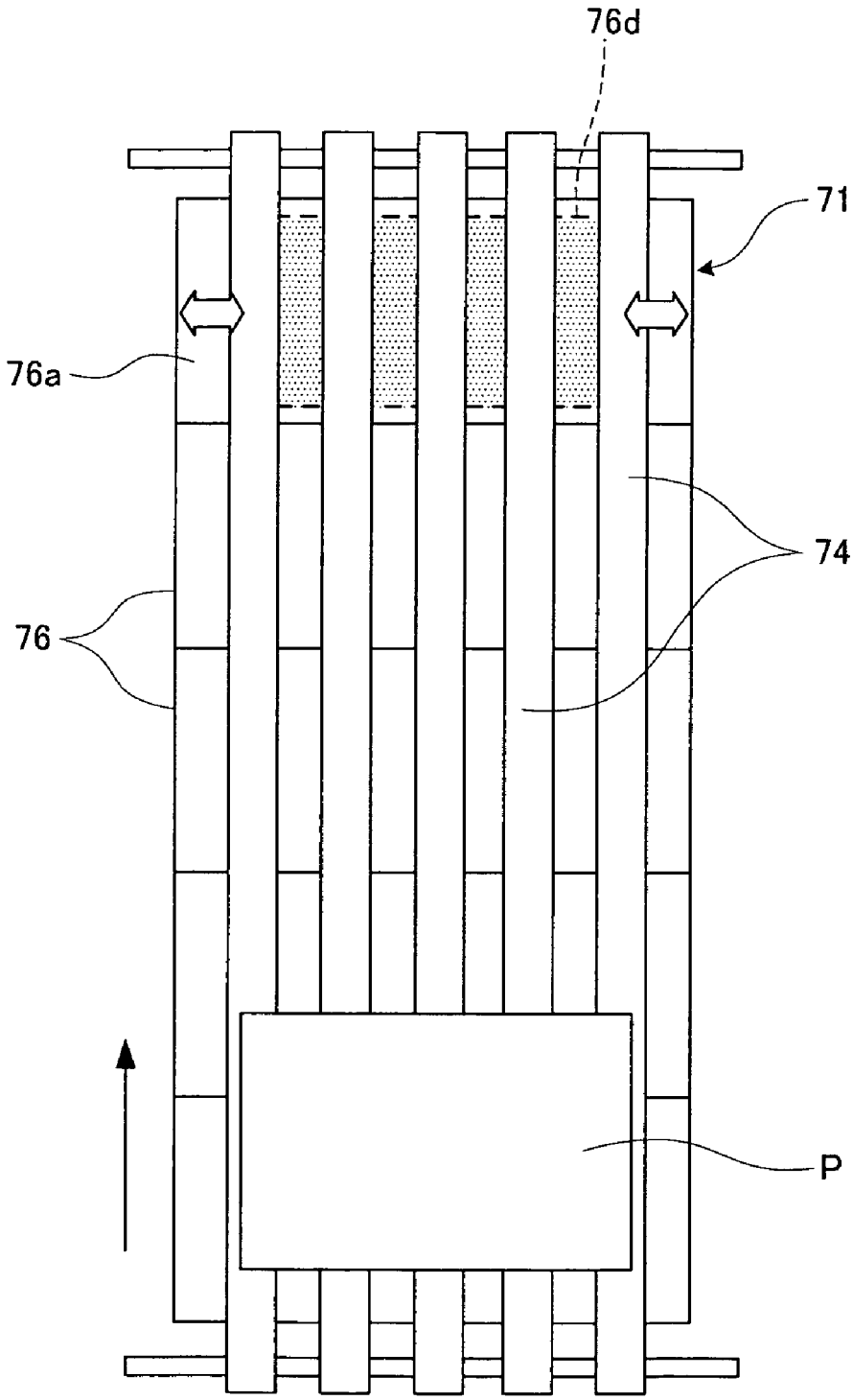
FIG. 8 is a plan view showing a shutter device in the first paper inverting device according to the embodiment.
Figure 11A:
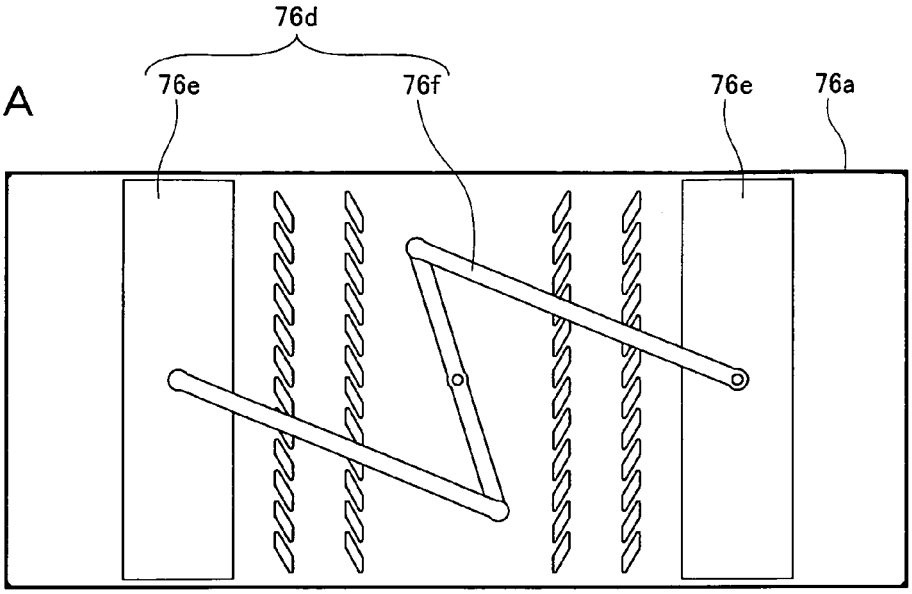
FIG. 11 is a plan view showing the shutter device in the first paper inverting device according to the embodiment.
Figure 11B:
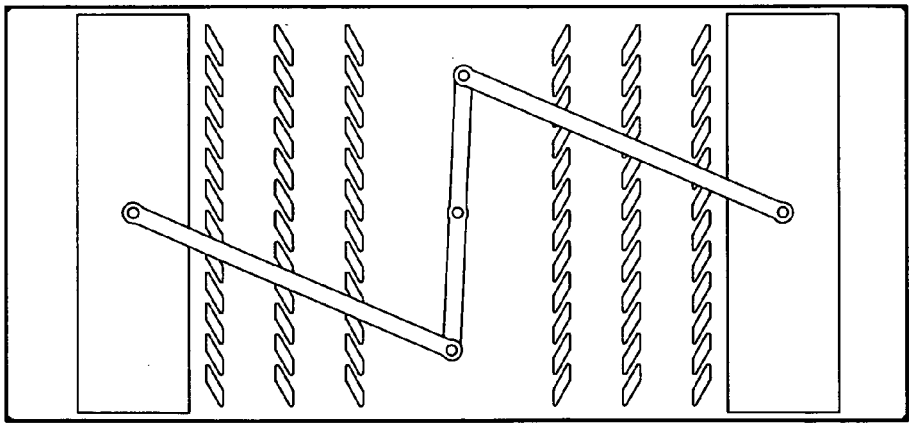
Figure 11C:
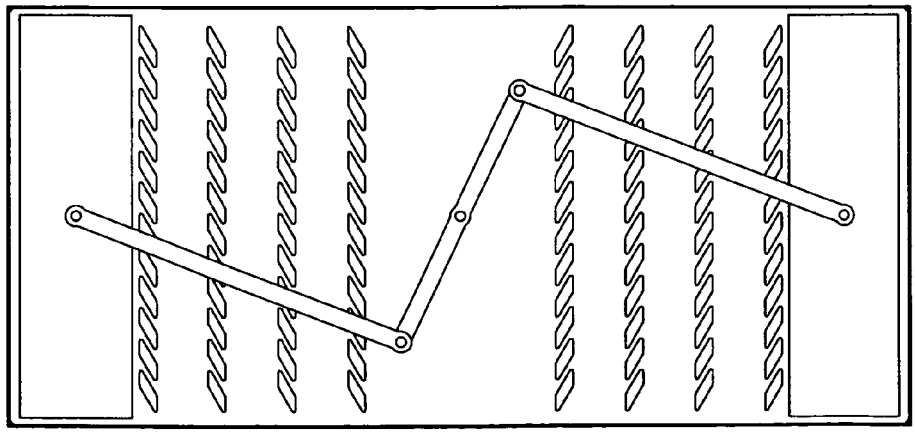

As shown in FIG. 8, the suction machine 76 closest to the inversion start points of the inversion/transfer surfaces 77*a* in the first transport device 71 and the suction machine 76 closest to the inversion end points of the inversion/transfer surfaces 77*a* in the second transport device 72 include shutter devices 76*d*, each acting as an opening adjusting device for making a variable adjustment on the opening degree of the opening 76*c* of the suction box 76*a* in a paper width direction orthogonal to the paper transport direction. As shown in FIGS. 11A to 11C, the shutter device 76*d* includes a link mechanism 76*f* for simultaneously moving shutters 76*e* on the right and left. The link mechanism 76*f* is driven by a motor and the like.

Figure 3:
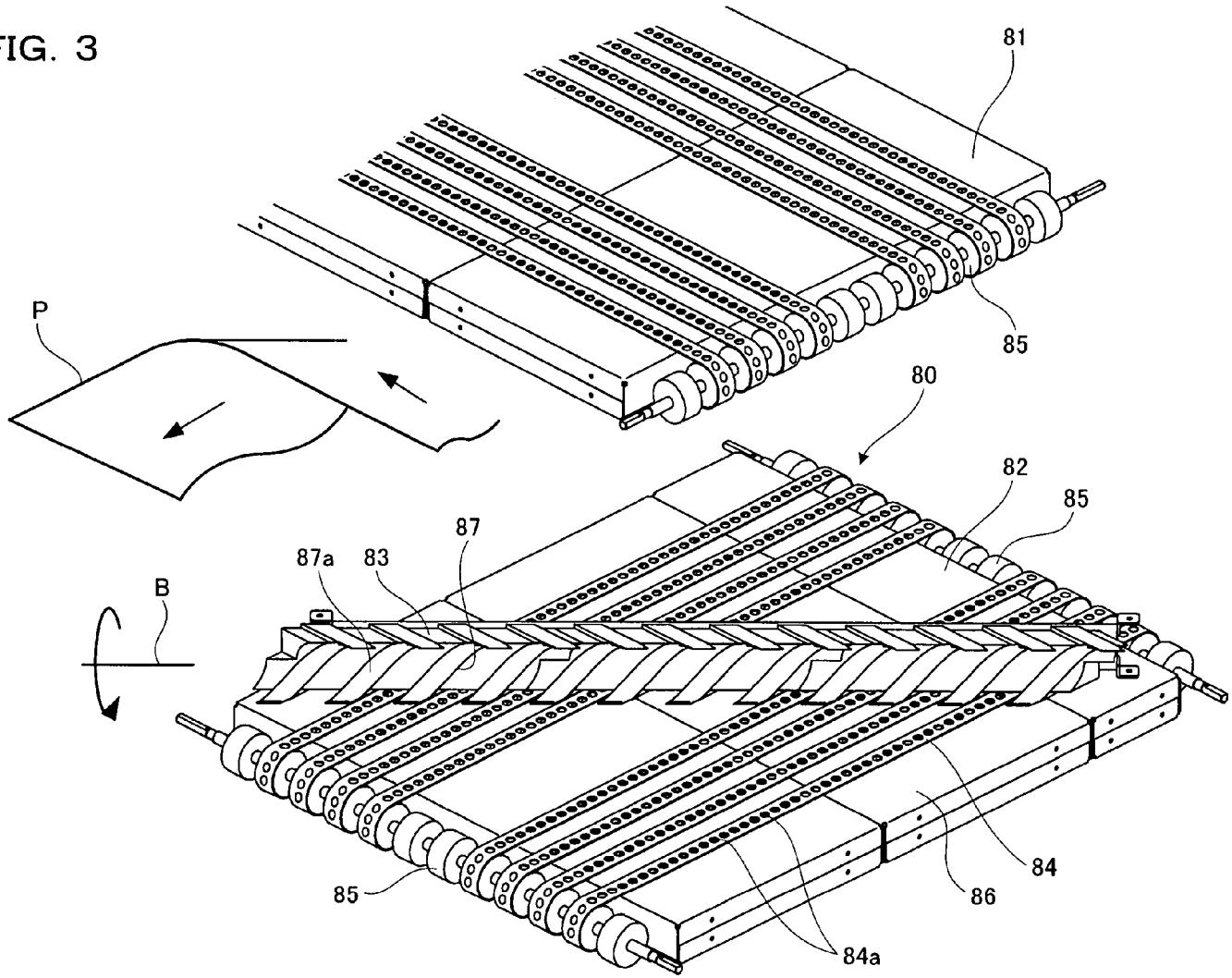
FIG. 3 is a perspective view showing a second paper inverting device according to the embodiment.

As shown in FIG. 3, the second paper inverting device 80 includes a first transport device 81 forming a first transport surface (face down) on which a sheet of paper is transported in the horizontal direction, a second transport device 82 forming a second transport surface (face up) which is opposed to the first transport surface and has a sheet transported in the horizontal direction, and a turn guide 83 which inverts the sheet P around an inversion axis B by a predetermined inversion angle, in this case, by 180° when the sheet P is transferred from the first transport surface to the second transport surface, and changes the transport direction of the sheet by a predetermined turning angle, in this case, by 90°.

The upper first transport device 81 and the lower second transport device 82 are disposed at relative positions where the paper transport directions are orthogonal to each other. At the relative positions, the inversion axis B of the sheet P is tilted by 45° relative to a direction orthogonal to the paper transport directions. The turn guide 83 is in parallel with the inversion axis B.

The first transport device 81 and the second transport device 82 include a plurality of transport belts 84 moving on transport paths along the paper transport directions. The transport belts 84 are each made up of an endless belt looped over belt rollers 85 disposed on both ends of the transport paths.

The transport paths are formed on suction boxes 86*a* of a plurality of suction machines 86 acting as suction devices. As shown in FIG. 19, the suction box 86*a* communicates with a suction fan device 86*b* and has a plurality of openings 86*c* under the transport path. The sheet P is sucked on the transport belts through suction holes 84*a* formed on the transport belts 84.

The turn guide 83 has a plurality of guide ribs 87 which are arranged with a predetermined pitch along the inversion axis B, have a center distance of 20 mm to 50 mm in a direction orthogonal to the paper transport direction, and are interposed between the transport belts 84. The guide ribs 87 which are in slidable contact with the sheet P have slidable contact portions forming curved inversion/transfer surfaces 87*a* from an inversion start point corresponding to the first transport surface to an inversion end point corresponding to the second transport surface. On the inversion start point, the inversion/transfer surfaces 87*a* are directed to the paper transport direction of the first transport device 81. On the inversion end point, the inversion/transfer surfaces 87*a* are directed to the paper transport direction of the second transport device 82. Thus the inversion/transfer surfaces 87*a* are twisted by 90° between the inversion start point and the inversion end point (see FIGS. 4 and 5).

The third paper inverting device 90 is configured as the first paper inverting device 70. One end of the third paper inverting device 90 is connected to the second transport device 82 of the second paper inverting device 80 of the upper inverting transfer unit 6 and the other end of the third paper inverting device 90 is connected to the first transport device 71 of the first paper inverting device 70 of the lower inverting transfer unit 6.

In the present embodiment, the third paper inverting device 90 includes a first transport device 91 forming a first transport surface on which a sheet is transported in the vertical direction, a second transport device 92 forming a second transport surface on which a sheet is transported in the horizontal direction, a third transport device 93 forming a third transport surface on which a sheet is transported in the vertical direction, and a turn guide 94 which inverts a sheet of paper around an inversion axis by a predetermined inversion angle, in this case, by 90°. The first transport device 91 is connected to the upper inverting transfer unit 6 and the third transport device 93 is connected to the lower inverting transfer unit 6.

The first transport device 91, the second transport device 92, and the third transport device 93 include a plurality of transport belts 95 moving on transport paths along the paper transport directions. The transport belts 95 are each made up of an endless belt looped over belt rollers 96 disposed on both ends of the transport paths.

The transport paths are formed on suction boxes 97*a* acting as suction devices. The suction boxes 97*a* each communicate with an air suction source (not shown). As shown in FIGS. 10A and 10B, the suction box 97*a* has a plurality of openings 97*c* under the transport path. As shown in FIG. 19, the sheet P is sucked on the transport belts through suction holes 95*a* formed on the transport belts 95.

The turn guide 94 is identical to the turn guide 73 of the first paper inverting device 70 and thus the explanation thereof is omitted.

Figure 21A:
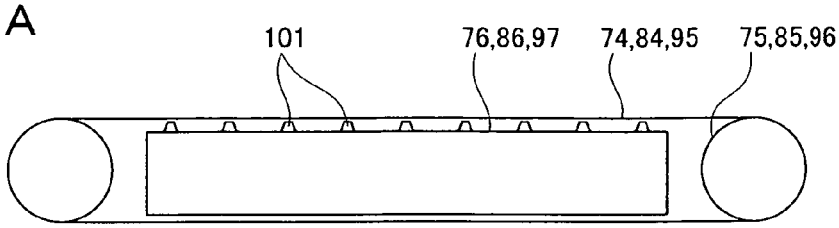
FIG. 21 is a schematic diagram showing the detail of the transport devices according to the embodiment of the present invention.
Figure 21B:
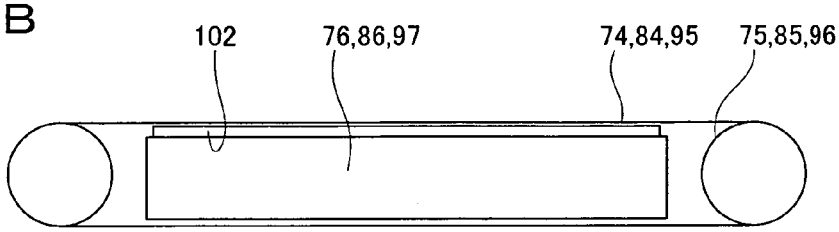
Figure 21C:
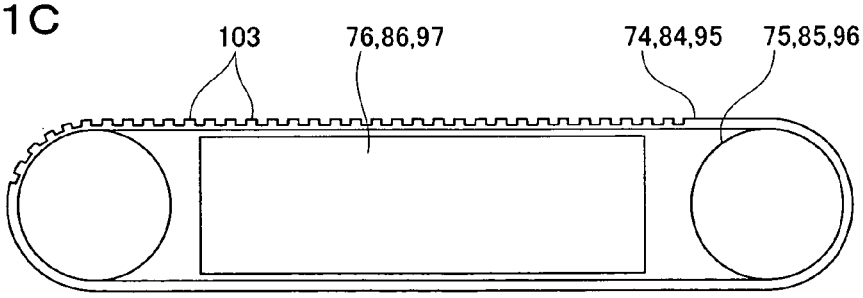
Figure 21D:
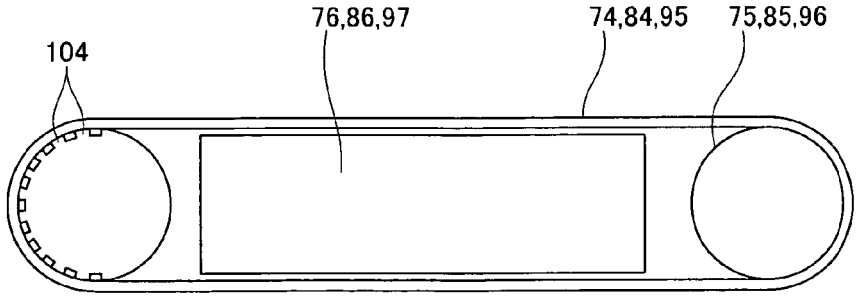
Figure 22A:
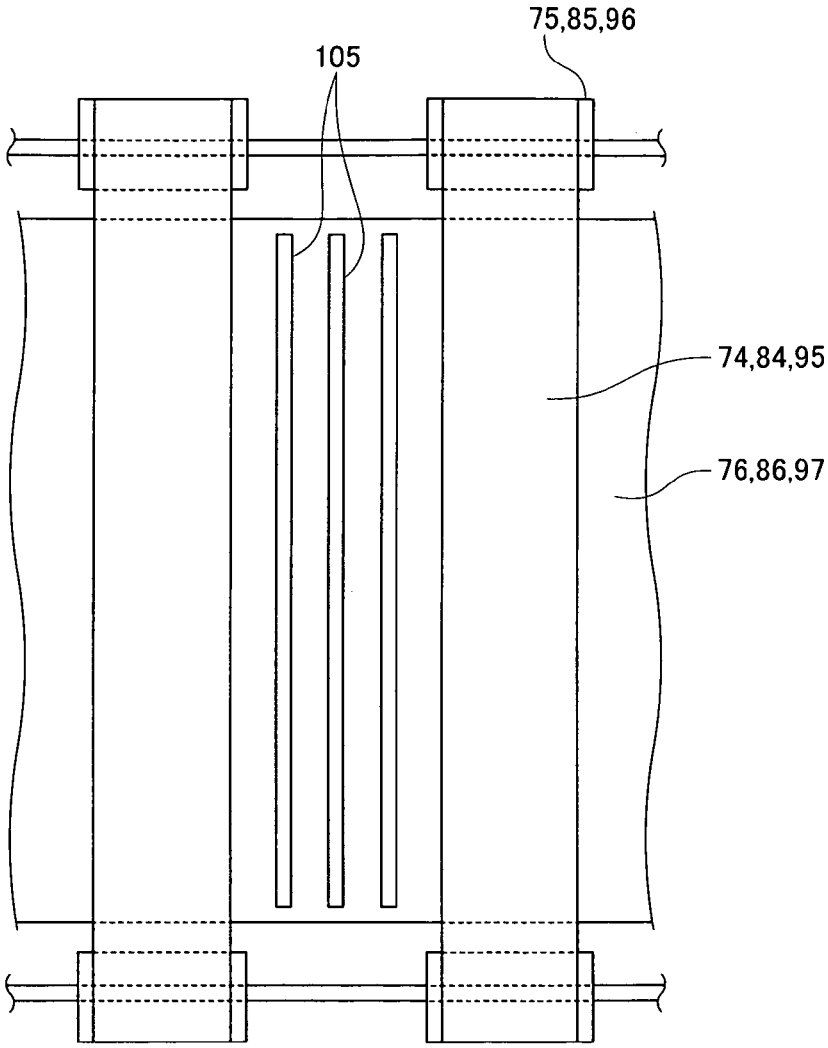
FIG. 22 is a schematic diagram showing the detail of the transport devices according to the embodiment of the present invention.
Figure 22B:
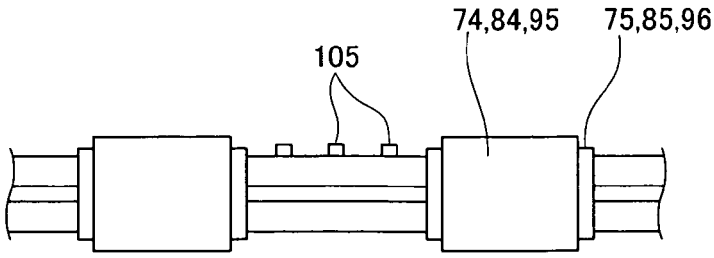

As shown in FIG. 21A, the transport devices 71, 72, 81, 82, 91, 92 and 93 may include a plurality of protrusions 101 formed as low-friction members on portions where the transport belts 74, 84 and 95 slide. Alternatively, a low-friction member 102 may be provided as shown in FIG. 21B. As shown in FIG. 21C, the transport belts 74, 84 and 95 have a plurality of protrusions 103 formed on the surfaces coming into contact with a sheet of paper. As shown in FIG. 21D, the belt rollers 75, 85 and 96 for driving the transport belts 74, 84 and 95 have a plurality of protrusions 104 formed on portions pressed to the transport belts. As shown in FIGS. 22A and 22B, the transport devices 71, 72, 81, 82, 91, 92 and 93 include a plurality of ribs 105 acting as paper support members between the transport belts 74, 84 and 95.

The ribs 105 are as high as or lower than the surfaces of the transport belts on the transport path. On a position corresponding to the inversion start point of the turn guide, the ribs 105 are higher than the inversion/transfer surfaces. On a position corresponding to the inversion end point of the turn guide, the ribs 105 are lower than the inversion/transfer surfaces. The corners of the top surfaces of the ribs coming into contact with a sheet of paper are disposed along the paper transport direction and the corners are preferably curved to prevent a scratch on the sheet.

The operation of the aforementioned configuration will be described below. The sheet P having one side printed by the printer body 3 enters the upper inverting transfer unit 6 of the paper inverting mechanism 4 and reaches the start end of the first transport device 71 of the first paper inverting device 70.

At this point, the sensor 70*b* detects the passage of the sheet P and then the number of steps of the encoder mounted in the driving motor of the belt roller 75, so that the current transport position of the sheet is calculated. The transport position of the sheet P is continuously monitored in the first transport device 71 and the second transport device 72.

As shown in FIG. 19, the first transport device 71 sucks on the transport belts the opposite side of the sheet P from the printed surface through the suction holes 74*a* formed on the transport belts 74, by means of the suction box 76*a*.

At this point, in the suction machine 76 closest to the transport start end of the first transport surface, the length of the suction box 76*a* in the paper transport direction and the formation range of the openings 76*c* in the paper transport direction are set smaller than the lengths and formation ranges of the other suction machines 76. Further, the control BOX 70*a* controls the suction fan device 76*b* of the suction machine 76 so as to set the suction force stronger than the suction forces of the other suction machines 76.

Consequently, the end of the sheet P entering the first transport surface is strongly sucked by the suction machine 76 on the transport start end of the first transport device 71. Thus even when the sheet P enters the first transport surface with a curled end, the end of the sheet P can be reliably sucked on the transport belts. Further, the timing of the suction of the end of the sheet P is not shifted and thus the sheet P can be reliably transported by suction in synchronization with transport from a printing process without causing a transport delay or a slip.

In this case, an increase in the suction forces of all the suction machines results in excessive suction energy. Energy consumption can be suppressed by increasing only the suction force of the suction machine closest to the turn guide.

As shown in FIG. 2, the transport belts 74 move on the transport path with the sheet in a state in which the first transport device 71 sucks the sheet P on the transport belts through the suction holes 74*a* formed on the transport belts 74, so that the sheet P is transported in the paper transport direction on the first transport surface.

At this point, the control BOX 70*a* sequentially drives the suction machines 76 as the sheet P moves in the transport direction. The control BOX 70*a* always drives at least the suction machines 76 corresponding to the transport positions of the sheet P, and stops the suction machines 76 or reduces the suction forces of the suction machines 76 when the suction machines 76 are not disposed on the transport positions of the sheet P and are not involved in transport.

Driving of all the suction machines causes excessive energy consumption. By sequentially driving only the minimum necessary suction machines 76 including at least the suction machines 76 corresponding to the transport positions of the sheet P as the sheet P moves in the transport direction, energy consumption can be minimized and noise can be reduced.

When the sheet P is ejected to the paper receiving unit 7 through the paper inverting mechanism 4 in the shortest time, as shown in FIG. 6, the guide ribs 77 of the turn guide 73 are operated so as to separate the first transport surface and the second transport surface, and then the sheet P is ejected from the first transport device 71 to the paper receiving unit 7.

After printed in the printer body 3, when the sheet P has to be kept in the paper inverting mechanism 4 for a longer time to dry the printed surface of the sheet, as shown in FIG. 7, the guide ribs 77 of the turn guide 73 are operated so as to connect the first transport surface and the second transport surface.

This configuration can be provided at a certain point of the third transport device 93 to switch, when a mechanism is provided to return the sheet to the printer body 3, a state in which the sheet is introduced into the mechanism and a state in which the sheet is not introduced into the mechanism.

As shown in FIG. 2, the first transport device 71 transports the sheet P in the paper transport direction on the first transport surface, the sheet P reaches the turn guide 73, and then the end of the sheet enters the inversion/transfer surfaces 77*a* from the inversion start point of the turn guide 73.

At this point, in the suction machine 76 closest to the inversion start points of the inversion/transfer surfaces 77*a* in the first transport device 71, the length of the suction box 76*a* in the paper transport direction and the formation range of the openings 76*c* in the paper transport direction are set smaller than the lengths and formation ranges of the other suction machines 76. Further, the control BOX 70*a* controls the suction fan device 76*b* of the suction machine 76 closest to the inversion start points of the inversion/transfer surfaces 77*a* such that the suction force of the suction machine 76 is set stronger than the suction forces of the other suction machines 76. The control BOX 70*a* controls the suction forces according to the paper transport conditions, for example, the kind (size, thickness, and so on) of a sheet or the transport speed of the transport device.

By setting the suction force of the suction machine 76 closest to the turn guide 73 stronger than the suction forces of the other suction machines 76, it is possible to reliably hold the sheet P by suction at the front and rear of the turn guide 73 on the transport path of the sheet P. Thus it is possible to prevent a paper jam caused by the sheet P lifted at the turn guide 73 and prevent skewing.

In this case, an increase in the suction forces of all the suction machines 76 results in excessive suction energy. Energy consumption can be suppressed by increasing only the suction force of the suction machine 76 closest to the turn guide 73.

Next, as the sheet P moves in the paper transport direction, the guide ribs 77 guide the end of the sheet with the inversion/transfer surfaces 77*a*, the back side of the sheet P comes into slidable contact with the inversion/transfer surfaces 77*a*, and the surfaces of the sheet P are inverted and curved along the inversion/transfer surfaces 77*a*, following the end of the sheet. In this case, the sheet P is inverted by 90°.

The sheet P reaches the second transport device 72 and one end of the sheet enters the second transport surface from the inversion end points of the inversion/transfer surfaces 77*a* of the guide ribs 77 of the turn guide 73.

At this point, in the suction machine 76 closest to the inversion end points of the inversion/transfer surfaces 77*a* in the second transport device 72, the length of the suction box 76*a* in the paper transport direction and the formation range of the openings 76*c* in the paper transport direction are set smaller than the lengths and formation ranges of the other suction machines 76. Further, the control BOX 70*a* controls the suction fan device 76*b* of the suction machine 76 closest to the inversion end points of the inversion/transfer surfaces 77*a* such that the suction force of the suction machine 76 is set stronger than the suction forces of the other suction machines 76.

Thus the second transport device 72 strongly sucks the end of the sheet P entering from the inversion/transfer surfaces 77*a* to the second transport surface, through the suction holes 74*a* of the transport belts 74. The transport belts 74 move on the transport path with the sheet P, so that the sheet P is transported in the paper transport direction on the second transport surface.

At this point, the control BOX 70*a* sequentially drives the suction machines 76 as the sheet P moves in the transport direction. The control BOX 70*a* always drives at least the suction machines 76 corresponding to the transport positions of the sheet P, and stops the suction machines 76 or reduces the suction forces of the suction machines 76 when the suction machines 76 are not disposed on the transport positions of the sheet P and are not involved in transport. Further, the first transport device 71 strongly sucks the sheet P by using the suction machine 76 closest to the inversion start points of the inversion/transfer surfaces 77*a* until the leading end of the sheet reaches the second transport device 72, and the first transport device 71 transports the sheet P until the rear end of the sheet reaches the inversion start point of the turn guide 73.

When the sheet P reaches the terminal end of the second transport device 72, one end of the sheet enters a turn guide (identical to the turn guide 73 and not shown in FIG. 2), is inverted by 90° as in the foregoing operation, and enters the second paper inverting device 80.

When the sheet P is transported by the first transport device 71 and the second transport device 72 by suction on the transport belts, the sheet P is not placed on some of the transport belts 74 depending on the size of the sheet P. When air flows into the suction boxes 76*a* through the suction holes 74*a* and the openings 76*c* of the suction boxes 76*a* on the transport belts 74 where the sheet P is not placed, a suction force applied to the sheet P decreases.

Thus the suction machines 76 closest to the inversion start points and the inversion end points of the inversion/transfer surfaces 77*a* make variable adjustments on the opening degrees of the openings 76*c* of the suction boxes 76*a* by means of the shutter devices 76*d*. As shown in FIGS. 11A to 11C, the shutter device 76*d* drives the link mechanism 76*f* with a motor and the like to simultaneously move the shutters 76*e* on the right and left, adjusts the opening degrees of the openings 76*c* of the suction box 76*a* according to the size of the sheet P, and closes the openings 76*c* corresponding to the transport belts 74 not involved in the transport of the sheet P. Thus it is possible to prevent an unnecessary air flow and increase the suction force applied to the sheet.

Consequently, it is possible to reliably hold the sheet P by suction at the front and rear of the turn guide 73 on the transport path of the sheet P according to the size of the sheet P. Thus it is possible to prevent a paper jam caused by the sheet P lifted at the turn guide 73 and prevent skewing.

As shown in FIG. 3, in the second paper inverting device 80, the first transport device 81 sucks the opposite side of the sheet P from the printed surface through the suction holes 84*a* formed on the transport belts 84, on the transport belts by means of the suction boxes 86. The transport belts 84 move on the transport path with the sheet P, so that the sheet P is transported in the paper transport direction on the first transport surface.

When the sheet P reaches the turn guide 83 and one end of the sheet P enters the inversion/transfer surfaces 87*a* from the inversion start point of the turn guide 83, the guide ribs 87 guide the end of the sheet with the inversion/transfer surfaces 87*a* as the sheet P moves in the paper transport direction, the back side of the sheet P comes into slidable contact with the inversion/transfer surfaces 87*a*, and the surfaces of the sheet P are inverted and curved along the inversion/transfer surfaces 87*a*, following the end of the sheet. In this case, the sheet is inverted by 180°.

At this point, the upper first transport device 81 and the lower second transport device 82 are disposed at relative positions where the paper transport directions are orthogonal to each other. The inversion axis B of the sheet P is tilted at the relative positions by 45° relative to a direction orthogonal to the paper transport direction and the turn guide 83 is disposed in parallel with the inversion axis B.

Therefore, one corner of the end of the sheet P first reaches the turn guide 83 and then the end of the sheet enters the inversion/transfer surfaces 87*a* from the corner of the end. The entry of the end of the sheet P to the inversion/transfer surfaces 87*a* is delayed as being close to the other corner of the end of the sheet P. The sheet P is first inverted from the corner having first entered the inversion/transfer surfaces 87*a* and the start of the inversion is delayed as being close to the other corner of the end of the sheet P, so that the transport direction of the sheet P is changed.

In other words, when the sheet P is transferred from the first transport surface to the second transport surface, the turn guide 83 inverts the sheet P by, the predetermined inversion angle around the inversion axis tilted by a predetermined angle of 45° relative to a direction orthogonal to the paper transport direction of the first transport device 81, so that the transport direction of the sheet P is changed by a predetermined turning angle of 90°.

Figure 4:
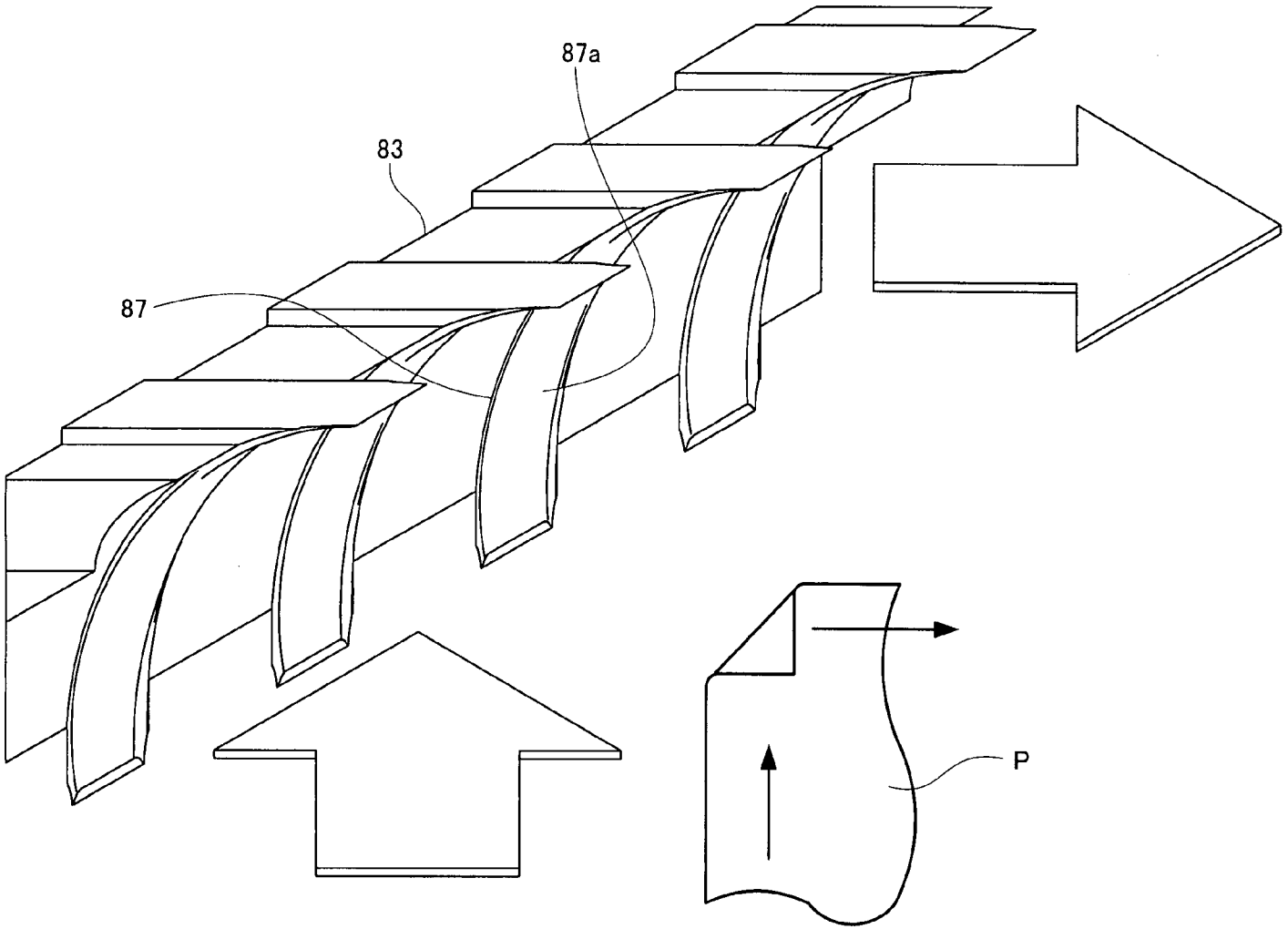
FIG. 4 is a perspective view showing a turn guide in the second paper inverting device according to the embodiment.
Figure 5:
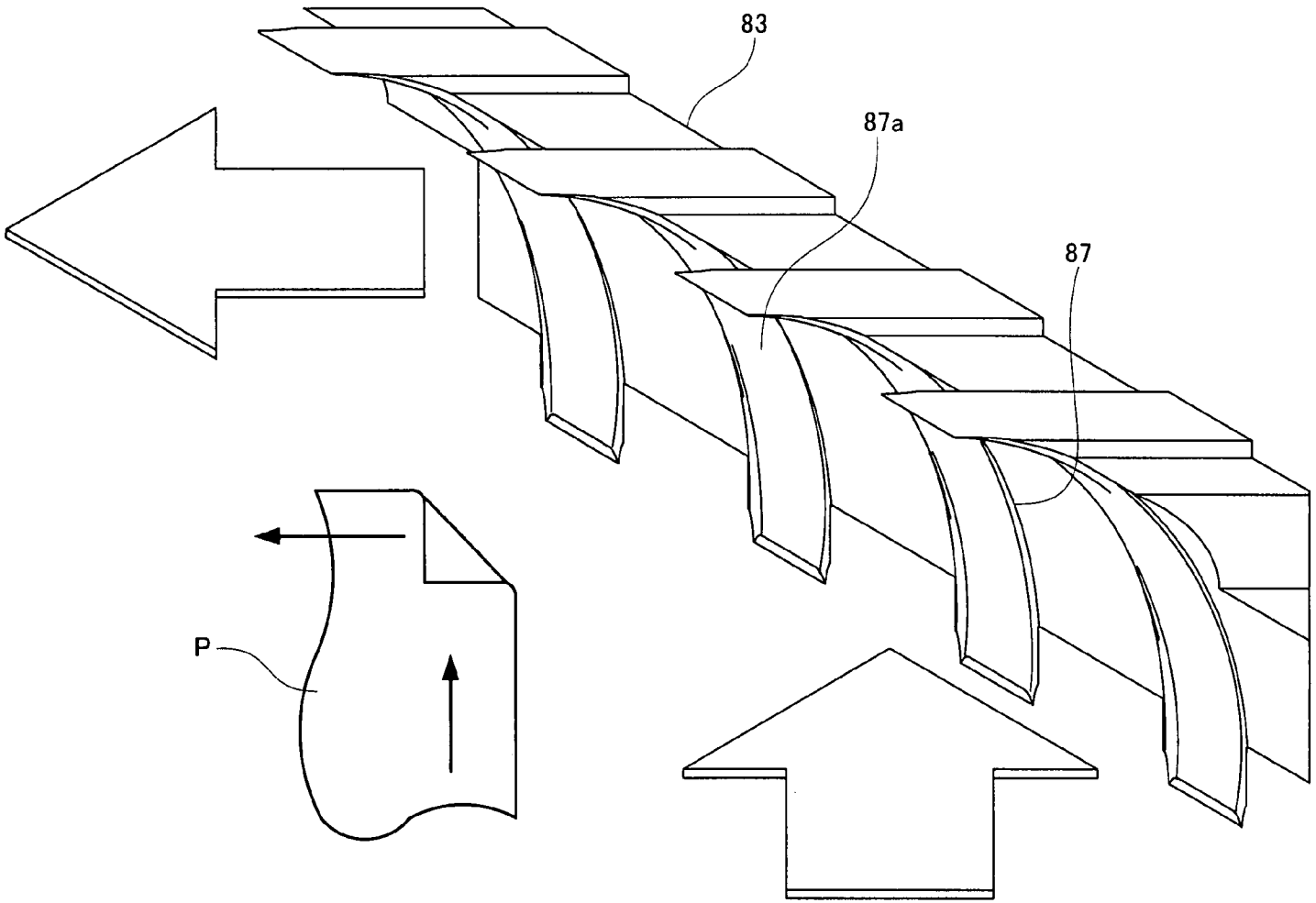
FIG. 5 is a perspective view showing another turn guide in the second paper inverting device according to the embodiment.

FIG. 4 shows the shape of the turn guide 83 when the paper transport direction is changed to the right by 90° and is inverted by 180°. FIG. 5 shows the shape of the turn guide 83 when the paper transport direction is changed to the left by 90° and is inverted by 180°.

When the sheet P reaches the second transport device 82 and the end of the sheet enters the second transport surface from one corner of the end, the second transport device 82 transports the sheet P in the paper transport direction on the second transport surface. At this point, on the second transport surface, the sheet P returns to a position where the end is in parallel with a direction orthogonal to the paper transport direction.

When the sheet P reaches the terminal end of the second transport device 82, one end of the sheet enters a turn guide (identical to the turn guide 73 and not shown in FIG. 3), is inverted by 90° as in the foregoing operation, and enters the third paper inverting device 90.

The third paper inverting device 90 repeatedly inverts the sheets P by 90° while transporting the sheets P by the same operation as the first paper inverting device 70, and feeds the sheets P to the first transport device 71 of the first paper inverting device 70 in the lower inverting transfer unit 6.

As has been discussed, the sheet P is inverted and the transport direction is changed in the upper inverting transfer unit 6 of the paper inverting mechanism 4, the sheet P is transferred to the lower inverting transfer unit 6, and then the sheet P is inverted and the transport direction is changed in the lower inverting transfer unit 6 as in the upper inverting transfer unit 6. After that, the sheet P is ejected to the paper receiving unit 7.

When paper powder from the transported sheet P falls between the transport belts 74, 84 and 95 and the sheet P sucked on the transport belts, the sheet P may slide. However, by collecting paper powder between the plurality of protrusions 103 provided on the transport belts 74, 84 and 95, it is possible to prevent the paper powder from falling between the transport belts 74, 84 and 95 and the sheet P, so that the sheet can be reliably transported. Further, by engaging the rear end of the sheet onto the protrusions 103 of the transport belts 74, 84 and 95, the sheet P can be reliably pressed and transported.

Further, when paper powder falls between the transport belts 74, 84 and 95 and the belt rollers 75, 85 and 96, the transport belts 74, 84 and 95 may slide. However, by collecting paper powder between the plurality of protrusions 104 provided on the belt rollers 75, 85 and 96, it is possible to prevent the paper powder from falling between the belt rollers 75, 85 and 96 and the transport belts 74, 84 and 95, so that the transport belts 74, 84 and 95 can be reliably driven.

It is preferable that the protrusions 103 provided on the transport belts 74, 84 and 95 are 0.5 mm or less in height. When the heights of the protrusions exceed 0.5 mm, air leaks between the protrusions 103 and the suction force is reduced, so that the sheet P may not be sufficiently sucked.

Figure 20:
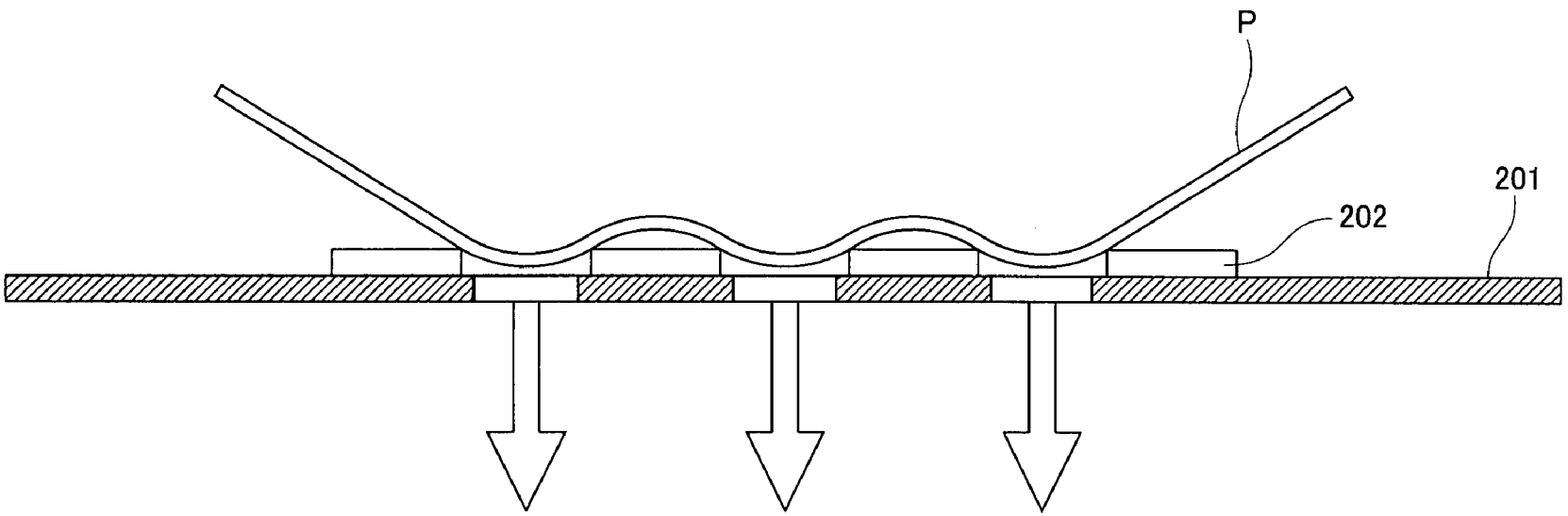
FIG. 20 PRIOR ART
FIG. 20 is a sectional view showing a transport state in a transport device of the prior art.

As shown in FIG. 20, in a configuration where a suction box 201 sucks the sheet P between transport belts 202, the sheet P enters between the transport belts 202 and dents are formed on the sheet P. On the reverse side of the sheet P, protrusions are formed between the transport belts 202 and the sheet P is wrinkled.

However, in the present embodiment, as shown in FIG. 19, the first transport devices 71, 81 and 91 and the second transport devices 72, 82 and 92 of the first to third paper inverting devices 70, 80 and 90 and the third transport device 93 of the third paper inverting device 90 suck on the transport belts the opposite side of the sheet P from the printed surface through the suction holes 74*a*, 84*a* and 95*a* formed on the transport belts 74, 84 and 95, by means of the suction boxes 76*a*, 86*a* and 97*a*. The transport belts 74, 84 and 95 move on the transport path with the sheet P, so that the sheet P is transported in the paper transport direction on the first transport surface. Thus it is possible to prevent a deformation of the sheet P. Further, the sheet P is supported by the ribs 105 between the transport belts to prevent a deformation of the sheet P, thereby preventing wrinkles when the sheet P is inverted.

Moreover, the diameters of the suction holes 74*a*, 84*a* and 95*a* of the transport belts 74, 84 and 95 are estimated at least 5 mm to obtain a suction force allowing the transport belts 74, 84 and 95 to securely hold the sheet P at the suction holes 74*a*, 84*a* and 95*a*. When the suction holes 74*a*, 84*a* and 95*a* are formed at the centers of the transport belts 74, 84 and 95, it is preferable to leave at least a 5-mm width on each side of the suction holes 74*a*, 84*a* and 95*a* in consideration of the strengths of the belts. As a result, the belts have to be at least 15 mm in width. Moreover, the guide ribs have to be at least 2 mm in width in order to sufficiently hold the underside of the sheet.

As has been discussed, it is most preferable that the guide ribs have a center distance of at least 20 mm in a direction orthogonal to the paper transport direction, in consideration of gaps between the guide ribs and the transport belts. When spacing between the guide ribs is too large, the end of the sheet is likely to be inserted between the guide ribs. Thus it is preferable to suppress the center distance between the guide ribs to 50 mm or less according to test results.

Figure 12:
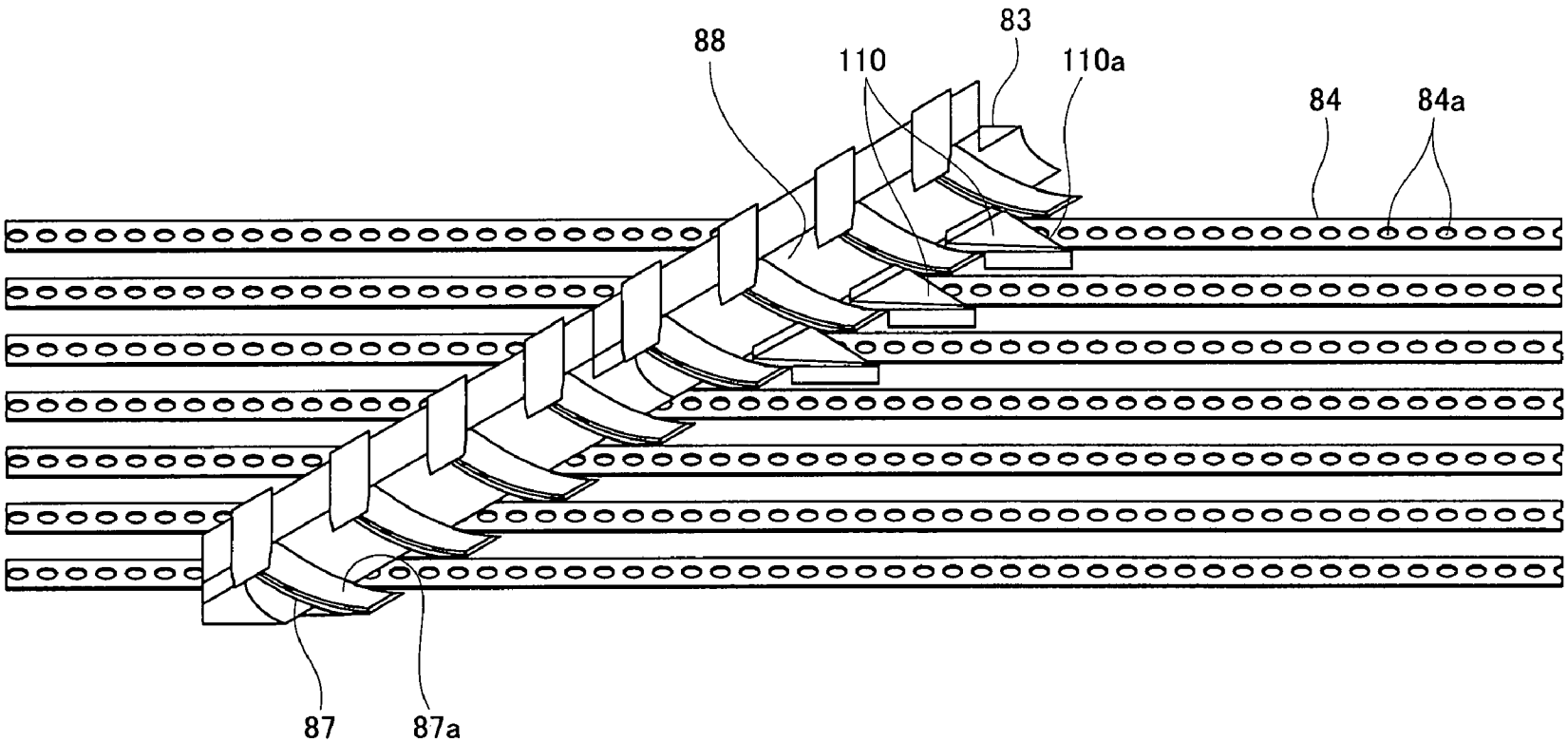
FIG. 12 is a perspective view showing a turn guide in a second paper inverting device according to another embodiment of the present invention.
Figure 13:
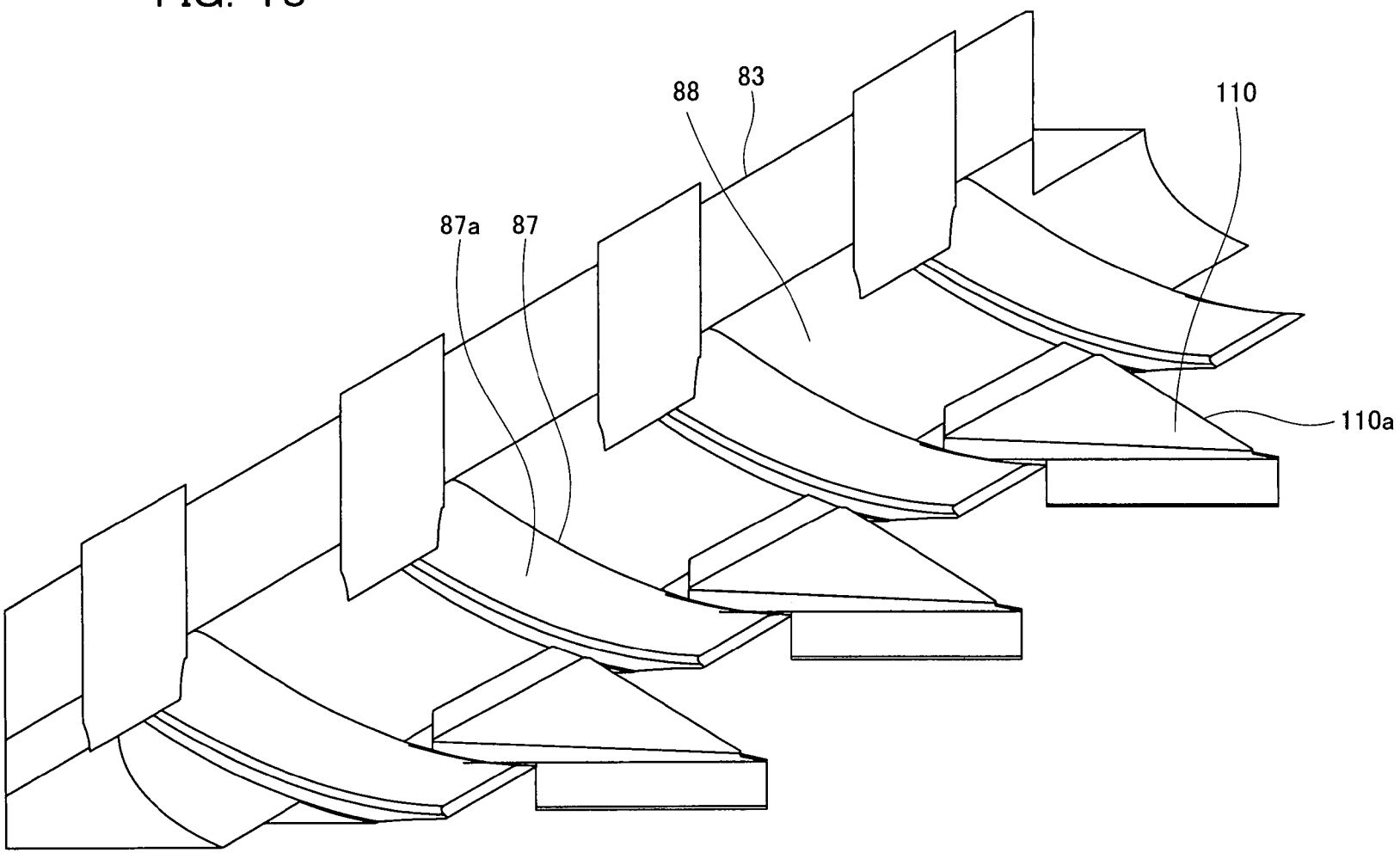
FIG. 13 is an enlarged perspective view showing the turn guide.
Figure 14:
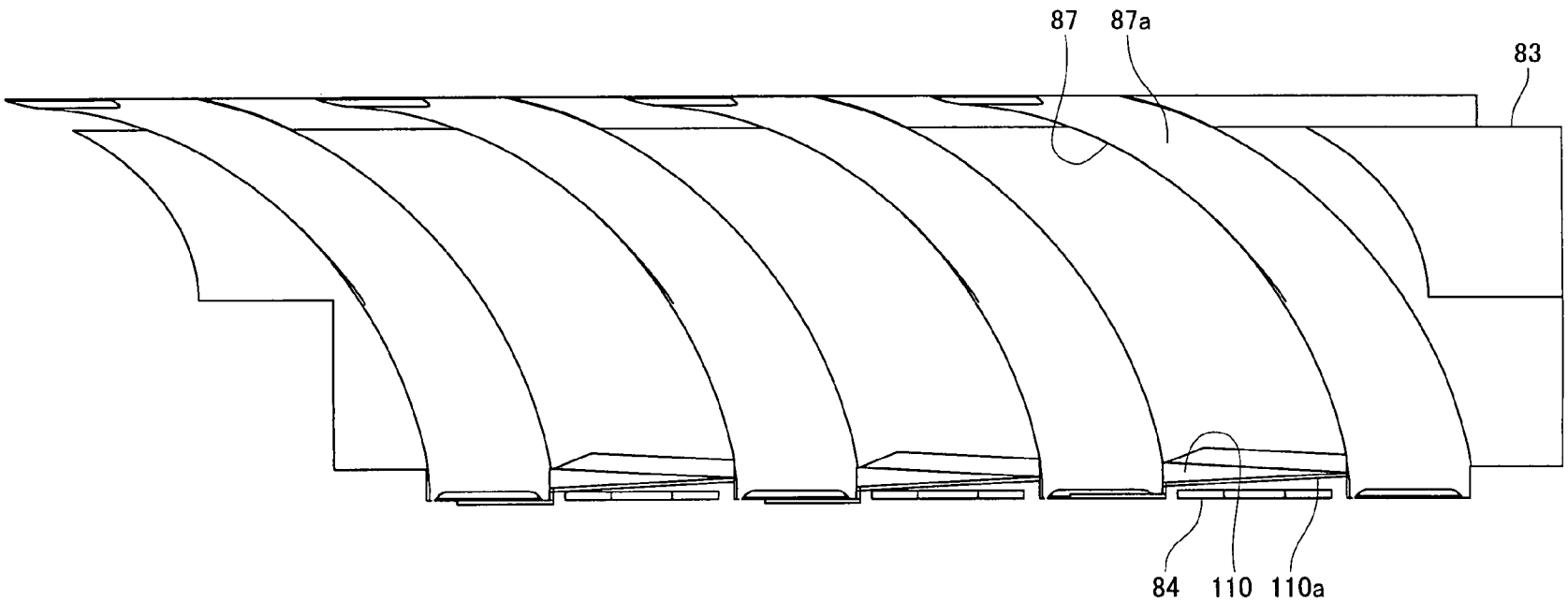
FIG. 14 is a front view showing the turn guide.

FIGS. 12 to 14 show another embodiment of the present invention. This embodiment is based on the configuration of the second paper inverting device 80 shown in FIG. 3. To be specific, an upper first transport device 81 and a lower second transport device 82 are disposed at relative positions where paper transport directions are orthogonal to each other. An inversion axis B of a sheet P is tilted at the relative positions by 45° relative to a direction orthogonal to the paper transport directions and a turn guide 83 is disposed in parallel with the inversion axis B.

Therefore, a corner on one side of the sheet P first reaches the turn guide 83 and then one end of the sheet enters inversion/transfer surfaces 87*a* from the corner. The entry of the end of the sheet P to the inversion/transfer surfaces 87*a* is delayed as being close to a corner on the other side of the sheet P. The sheet P is first inverted from the corner having first entered the inversion/transfer surfaces 87*a* and the start of the inversion is delayed as being close to the corner on the other side of the sheet P, so that the transport direction of the sheet P is changed.

The turn guide 83 has a plurality of escape portions 110 at an inversion start point corresponding to a first transport surface and between guide ribs corresponding to the corner of the sheet. The escape portions 110 are disposed on positions first coming into contact with the sheets P of various sizes in the paper transport direction.

The escape portions 110 are extended from a guide rib 87 disposed inside the corner of the sheet to another guide rib 87 disposed outside the corner of the sheet, and escape portion front ends 110*a* which come into slidable contact with the end of the sheet are formed so as to gradually retreat in the paper transport direction as being close to the guide rib 87 disposed outside the corner of the sheet. The escape portion front ends 110*a* have an elevation angle tilted by a predetermined angle relative to the first transport surface of the first transport device 81. Further, the escape portion front ends 110*a* are tilted by a predetermined angle relative to a direction orthogonal to the transport direction in the first transport surface and are tilted by 30° to 60°.

In this configuration, the escape portions 110 have side edges which are in contact with the guide ribs 87 disposed inside the escape portions 110. The side edges are placed higher than the inversion/transfer surfaces 87*a* of the guide ribs 87 disposed inside the escape portions 110 and are formed along transport belts 84. Further, the escape portion front ends 110*a* are positioned on guide surfaces 88 which are formed between the guide ribs 87 by the rear ends of the escape portions having retreated in the paper transport direction. The escape portions 110 are preferably made up of flexible members separated from the turn guide 83.

With this configuration, when the sheet P is transferred from the first transport surface to a second transport surface, the sheet P is inverted by a predetermined inversion angle of 180° and the direction of the sheet P is changed by a predetermined turning angle of 90° by passage through the turn guide 83.

As the sheet moves in the paper transport direction, the guide ribs 87 guide the end of the sheet with the inversion/transfer surfaces 87*a*, the sheet is first inverted from the corner on one side having first entered the inversion/transfer surfaces, and the surfaces of the sheet P are inverted and curved along the inversion/transfer surfaces 87*a*, following the end of the sheet.

Figure 16:
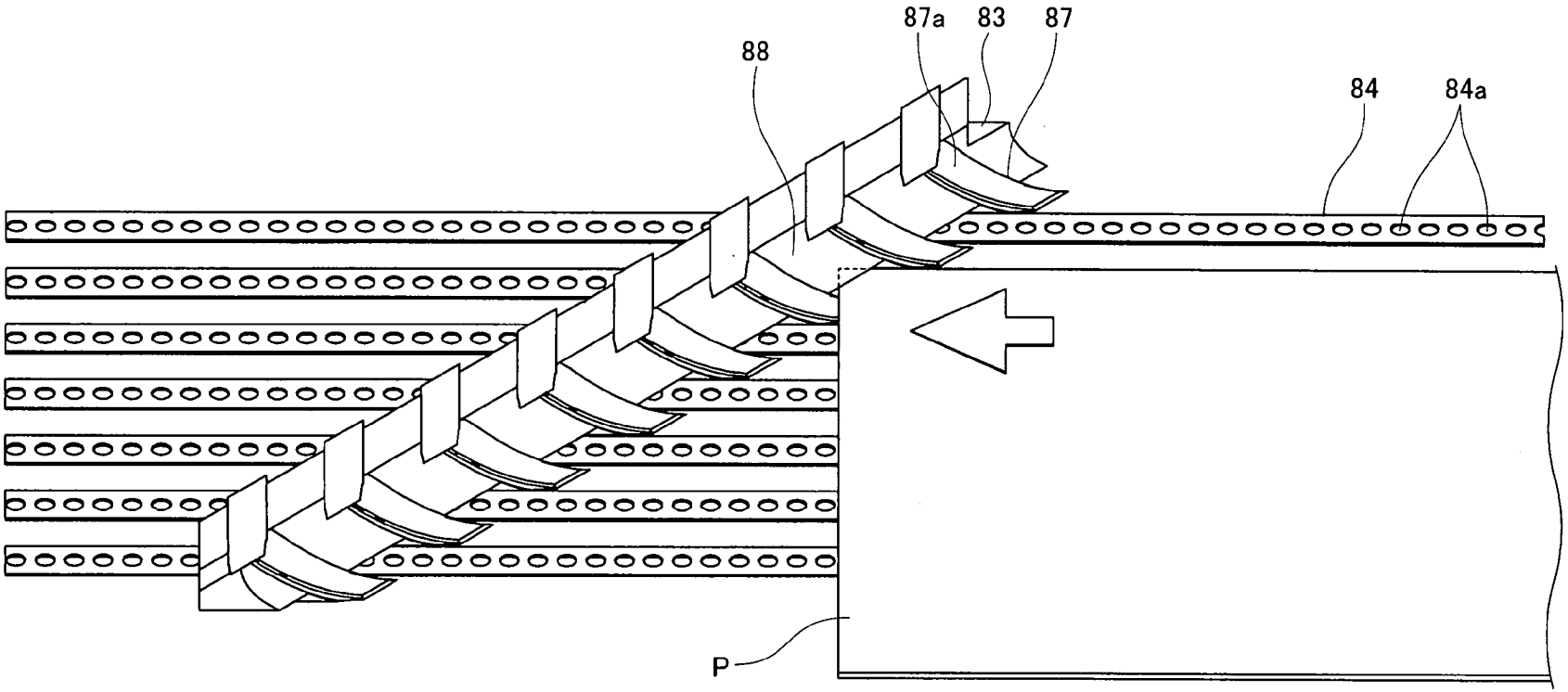
FIG. 16 is a schematic diagram showing a jam caused by the turn guide having no escape portions.

As shown in FIG. 16, when the escape portions 110 are not provided, a corner on one side of the sheet P enters between the guide ribs 87 while being bent lower than the inversion/transfer surfaces 87*a* by a curl and the like of the sheet P. In this case, the corner comes under the guide surface 88 between the guide ribs 87 and is not inverted, thereby interfering with the inversion of an edge on one side of the sheet P, following the corner of the end. Thus a paper jam occurs.

Figure 15:
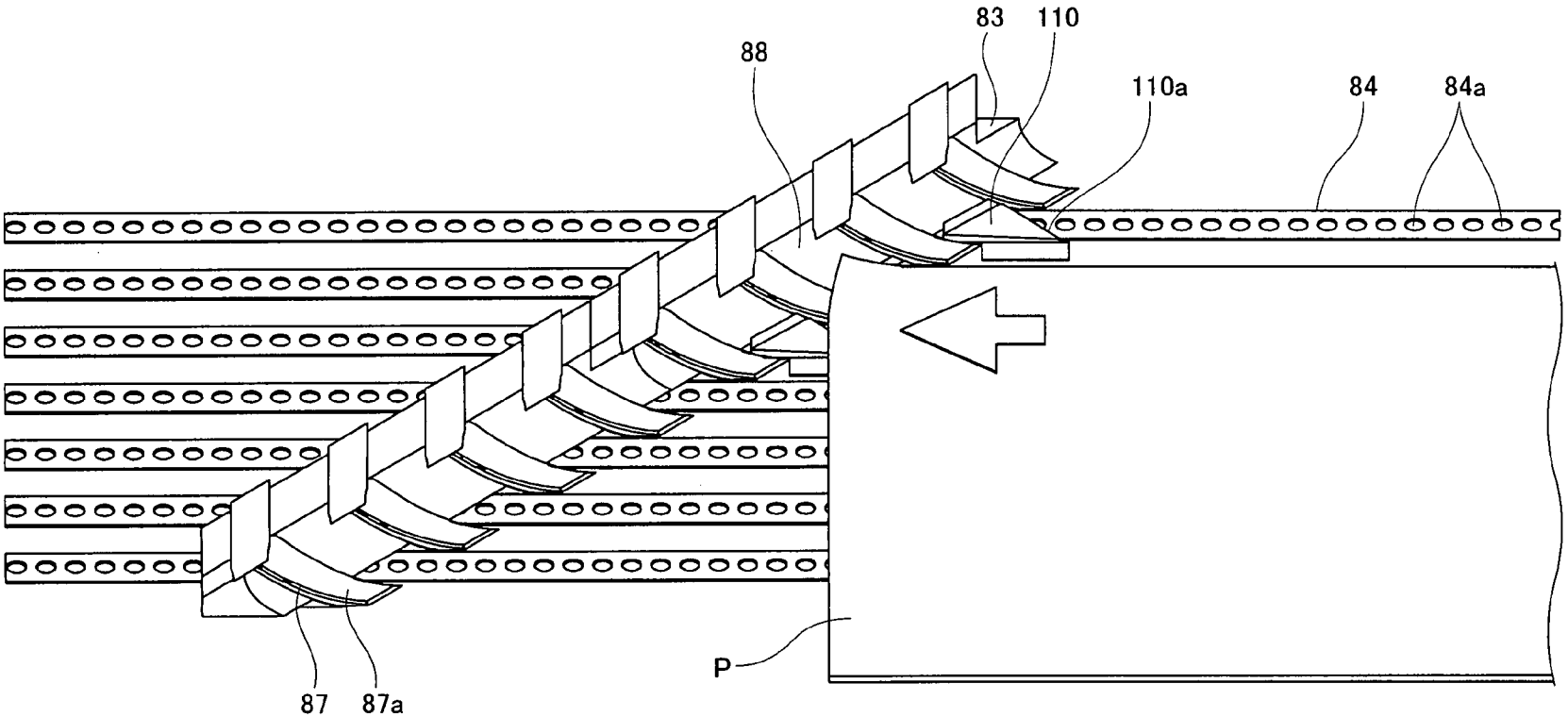
FIG. 15 is a schematic diagram showing the inversion of a sheet by the turn guide.

However, as shown in FIG. 15, the escape portion front ends 110*a* of the escape portions 110 are provided between the guide ribs 87 corresponding to the corner on one side of the sheet P and the escape portion front ends 110*a* come into slidable contact with the edge of the corner of the sheet P which is bent lower than the inversion/transfer surfaces 87*a*. The escape portion front ends 110*a* are formed so as to gradually retreat in the transport direction, so that as the sheet P moves in the paper transport direction, the escape portions 110 guide the end of the sheet upward with the escape portion front ends 110*a*, the position of the corner on one side of the sheet P is corrected, and the corner is smoothly inverted. Thus it is possible to prevent a paper jam.

Figure 17:
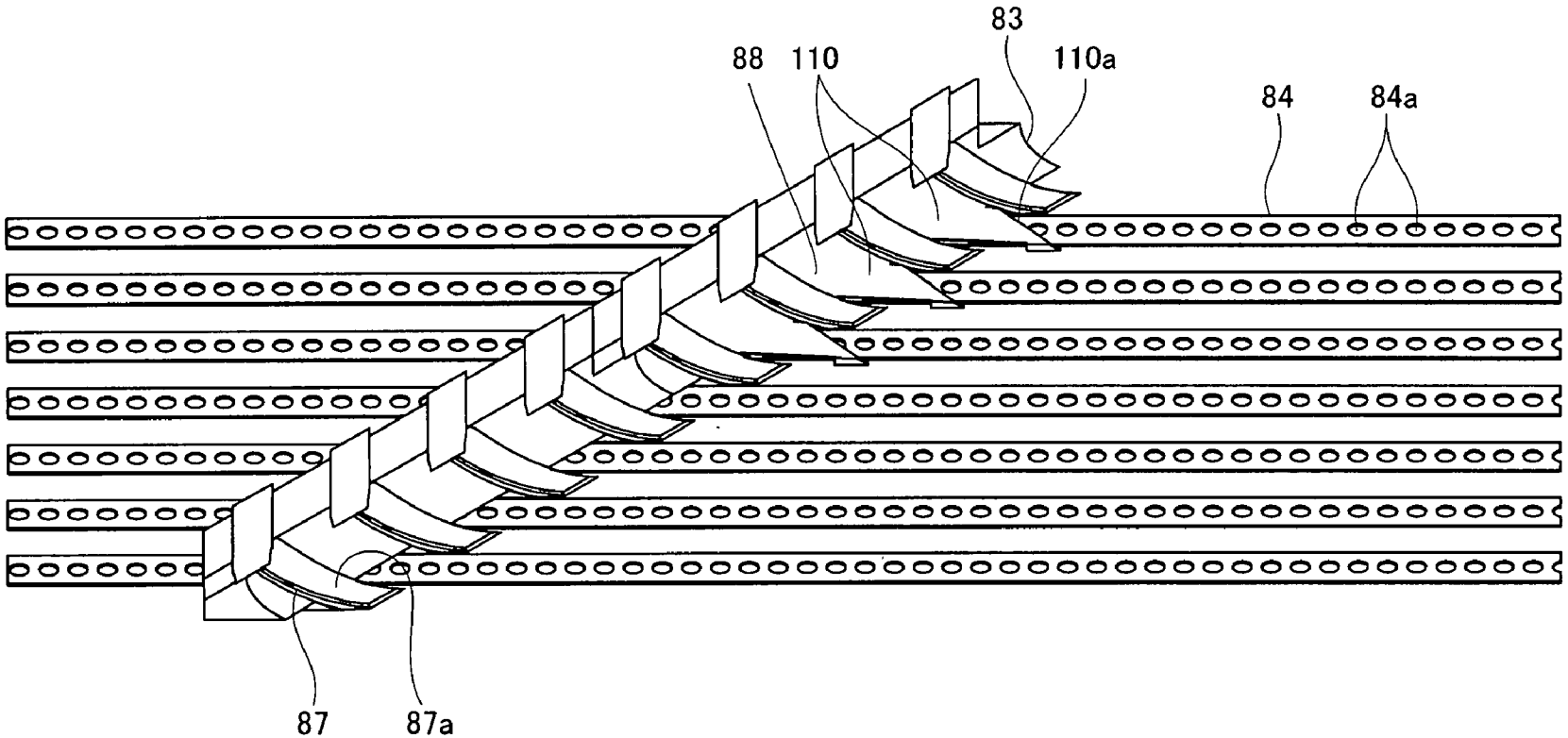
FIG. 17 is a perspective view showing a turn guide in a second paper inverting device according to another embodiment of the present invention.
Figure 18:
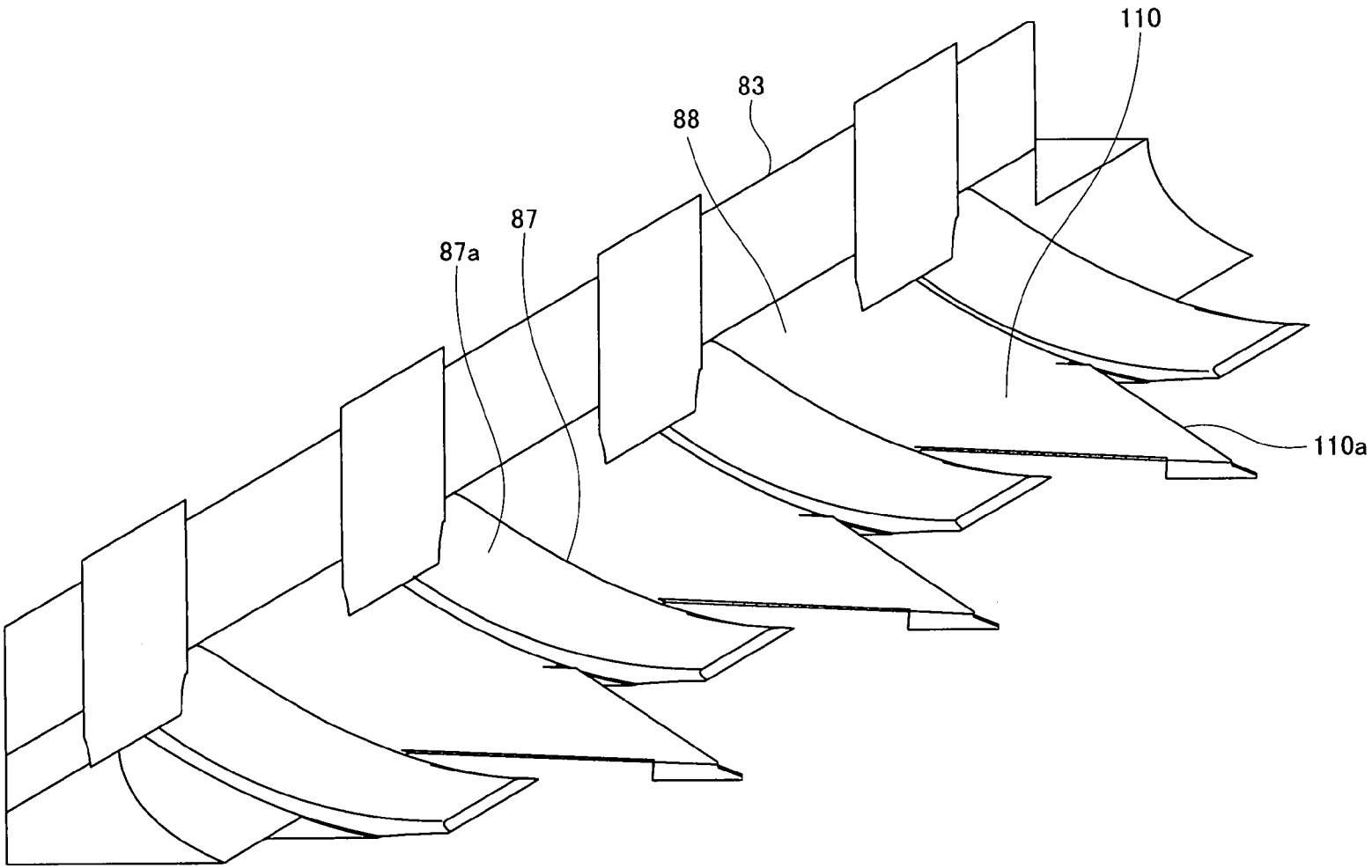
FIG. 18 is an enlarged perspective view showing the turn guide.

As shown in FIGS. 17 and 18, the escape portions 110 may be formed such that the escape portions 110 have side edges coming into contact with the guide ribs 87 disposed inside the corner of the sheet and placed higher than the inversion/transfer surfaces 87*a* of the guide ribs 87 disposed inside the corner of the sheet and the escape portion front ends 110*a* have escape portion rear ends retreated in the paper transport direction and placed higher than the inversion/transfer surfaces 87*a* of the guide ribs 87 disposed outside the corner of the sheet.

The invention claimed is:

1. A paper inverting device for inverting a sheet of paper around an inversion axis by a predetermined inversion angle when the sheet is transferred from a first transport surface to a second transport surface, the paper inverting device comprising:

a first transport device forming the first transport surface;

a second transport device forming the second transport surface;

the first transport device and the second transport device each including a plurality of transport belts moving on transport paths along a paper transport direction and a suction device for sucking the sheet on the transport belts through suction holes formed on the transport belts;

a turn guide disposed in parallel with the inversion axis between the first transport device and the second transport device having curved transfer surfaces from inversion start points corresponding to the first transport surface to inversion end points corresponding to the second transport surface; and the suction device including a plurality of suction machines disposed along the paper transport direction and a suction force controller for individually controlling suction forces of the suction machines according to paper transport conditions;

wherein the suction force controller sets the suction force of the suction machine closest to the inversion start points of the transfer surfaces stronger than the suction forces of the other suction machines in the first transport device.

2. The paper inverting device according to claim 1, wherein the suction force controller sets the suction force of the suction machine closest to the inversion end points of the transfer surfaces stronger than the suction forces of the other suction machines in the second transport device.

3. The paper inverting device according to claim 1, wherein the suction force controller sets the suction force of the suction machine closest to a transport start end of the first transport surface stronger than the suction forces of the other suction machines in the first transport device.

4. The paper inverting device according to claim 1, further comprising a sensor device for detecting a transport position of the sheet in the first transport device, wherein the suction force controller sequentially drives at least the suction machines corresponding to the transport positions of the sheet as the sheet moves in the transport direction.

5. The paper inverting device according to claim 1, wherein the suction force controller controls the suction forces of the suction machines according to at least one of the paper transport conditions including a kind of paper and a transport speed.

6. A paper inverting device for inverting a sheet of paper around an inversion axis by a predetermined inversion angle when the sheet is transferred from a first transport surface to a second transport surface, the paper inverting device comprising:

a first transport device forming the first transport surface;

a second transport device forming the second transport surface;

the first transport device and the second transport device each including a plurality of transport belts moving on transport paths along a paper transport direction and a suction device for sucking the sheet on the transport belts through suction holes formed on the transport belts;

a turn guide disposed in parallel with the inversion axis between the first transport device and the second transport device having curved transfer surfaces from inversion start points corresponding to the first transport surface to inversion end points corresponding to the second transport surface; and the suction device including a plurality of suction machines disposed along the paper transport direction and a suction force controller for individually controlling suction forces of the suction machines according to paper transport conditions;

wherein the suction machines of the first transport device and the second transport device each comprise a suction box for supporting the transport belts under the transport paths and a suction source, the suction box composes a suction air flow path to the suction source from openings formed under the transport paths of the transport belts, in the suction machine closest to the inversion start points of the transfer surfaces in the first transport device, a length of the suction box in the paper transport direction and a formation range of the openings in the paper transport direction are set smaller than lengths and formation ranges of the other suction machines, and in the suction machine closest to inversion end points of the transfer surfaces in the second transport device, a length of the suction box in the paper transport direction and a formation range of the openings in the paper transport direction are set smaller than lengths and formation ranges of the other suction machines.

7. A paper inverting device for inverting a sheet of paper around an inversion axis by a predetermined inversion angle when the sheet is transferred from a first transport surface to a second transport surface, the paper inverting device comprising:

a first transport device forming the first transport surface;

a second transport device forming the second transport surface;

the first transport device and the second transport device each including a plurality of transport belts moving on transport paths along a paper transport direction and a suction device for sucking the sheet on the transport belts through suction holes formed on the transport belts;

a turn guide disposed in parallel with the inversion axis between the first transport device and the second transport device having curved transfer surfaces from inversion start points corresponding to the first transport surface to inversion end points corresponding to the second transport surface; and the suction device including a plurality of suction machines disposed along the paper transport direction and a suction force controller for individually controlling suction forces of the suction machines according to paper transport conditions;

wherein the first transport device comprises a suction box for supporting the transport belts under the transport paths and a suction source, the suction box composes a suction air flow path to the suction source from openings formed under the transport paths of the transport belts, and in the suction machine closest to a transport start end of the first transport surface in the first transport device, a length of the suction box in the paper transport direction and a formation range of the openings in the paper transport direction are set smaller than lengths and formation ranges of the other suction machines.

8. A paper inverting device for inverting a sheet of paper around an inversion axis by a predetermined inversion angle when the sheet is transferred from a first transport surface to a second transport surface, the paper inverting device comprising:

a first transport device forming the first transport surface;

a second transport device forming the second transport surface;

the first transport device and the second transport device each including a plurality of transport belts moving on transport paths along a paper transport direction and a suction device for sucking the sheet on the transport belts through suction holes formed on the transport belts;

a turn guide disposed in parallel with the inversion axis between the first transport device and the second transport device having curved transfer surfaces from inversion start points corresponding to the first transport surface to inversion end points corresponding to the second transport surface; and the suction device including a plurality of suction machines disposed along the paper transport direction and a suction force controller for individually controlling suction forces of the suction machines according to paper transport conditions;

wherein the suction machine closest to the inversion start points of the transfer surfaces in the first transport device and the suction machine closest to the inversion end points of the transfer surfaces in the second transport device each comprise a suction box which supports the transport belts under the transport paths and has openings formed under the transport paths and an opening adjusting device for making a variable adjustment on an opening degree of the opening of the suction box in a paper width direction orthogonal to the paper transport direction.

* * * * *